US012604945B2

(12) United States Patent
Connell et al.

(10) Patent No.: US 12,604,945 B2
(45) Date of Patent: Apr. 21, 2026

(54) BLADDER FOR AN ARTICLE OF FOOTWEAR

(71) Applicant: NIKE, Inc., Beaverton, OR (US)

(72) Inventors: Jeremy L. Connell, Portland, OR (US); Craig Fredrick, Portland, OR (US); Jason R. Meeker, Portland, OR (US); Chris Wilburn, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

(21) Appl. No.: 18/743,442

(22) Filed: Jun. 14, 2024

(65) Prior Publication Data

US 2024/0415229 A1 Dec. 19, 2024

Related U.S. Application Data

(60) Provisional application No. 63/508,427, filed on Jun. 15, 2023.

(51) Int. Cl.
*A43B 13/20* (2006.01)

(52) U.S. Cl.
CPC ..... *A43B 13/20* (2013.01)

(58) Field of Classification Search
CPC ..... A43B 13/20; A43B 13/203; A43B 13/206
USPC ..... 36/29, 35 B
See application file for complete search history.

(56) References Cited

U.S. PATENT DOCUMENTS 4,346,489 A 8/1982 McMullan
5,406,719 A * 4/1995 Potter ..... A43B 13/203 36/35 B
5,686,167 A 11/1997 Rudy
5,878,510 A * 3/1999 Schoesler ..... A43B 17/026 36/43
6,009,637 A * 1/2000 Pavone ..... A43B 13/141 36/28

(Continued)

FOREIGN PATENT DOCUMENTS

JP 2005506862 A * 3/2005 ..... A43B 13/203
TW 202131816 A 9/2021

(Continued)

OTHER PUBLICATIONS

English Translation of JP-2005506862-A (Year: 2005).*

(Continued)

*Primary Examiner* — Ted Kavanaugh
(74) *Attorney, Agent, or Firm* — Honigman LLP; Matthew H. Szalach; Jonathan P. O'Brien

(57) ABSTRACT

A bladder including a first barrier element having a first surface formed on a first side of the first barrier element and a second surface formed on an opposite side of the first barrier element than the first surface, a second barrier element having a third surface formed on a first side of the second barrier element and a fourth surface formed on an opposite side of the second barrier element than the third surface, and a peripheral seam joining the first barrier element and the second barrier element to define an interior void between the first surface and the third surface, the peripheral seam including a first segment extending along the bladder proximate to the second surface, a second segment extending along the bladder proximate to the fourth surface, and a third segment extending between and connecting the first segment and the second segment.

20 Claims, 15 Drawing Sheets

(56) References Cited

U.S. PATENT DOCUMENTS

| | | | | |
|---|---|---|---|---|
| 6,453,577 | B1 * | 9/2002 | Litchfield | A43B 13/203 36/35 B |
| 7,118,437 | B1 | 10/2006 | Bradley et al. | |
| 10,159,307 | B2 * | 12/2018 | Case | A43B 13/188 |
| 11,026,476 | B2 | 6/2021 | Eldem et al. | |
| 11,039,662 | B2 * | 6/2021 | Taylor | A43B 13/20 |
| 11,517,074 | B2 | 12/2022 | VanDomelen | |
| 2003/0183324 | A1 | 10/2003 | Tawney et al. | |
| 2006/0230636 | A1 * | 10/2006 | Kokstis | B29D 35/142 36/35 B |
| 2006/0277794 | A1 | 12/2006 | Schindler et al. | |
| 2007/0119075 | A1 | 5/2007 | Schindler et al. | |
| 2012/0233885 | A1 | 9/2012 | Shaffer et al. | |
| 2015/0223564 | A1 * | 8/2015 | Peyton | A43B 23/0255 36/28 |
| 2016/0295967 | A1 | 10/2016 | Campos, II et al. | |
| 2016/0295968 | A1 | 10/2016 | Campos, II et al. | |
| 2017/0042286 | A1 * | 2/2017 | Meschter | A43B 13/189 |
| 2017/0119096 | A1 | 5/2017 | Greene | |
| 2018/0303200 | A1 | 10/2018 | Greene | |
| 2018/0332925 | A1 | 11/2018 | Bailey et al. | |
| 2019/0231028 | A1 | 8/2019 | Eldem et al. | |
| 2020/0022454 | A1 | 1/2020 | Eldem et al. | |
| 2020/0022455 | A1 | 1/2020 | Eldem et al. | |
| 2020/0154825 | A1 | 5/2020 | Case et al. | |
| 2020/0154826 | A1 | 5/2020 | Case et al. | |
| 2020/0205514 | A1 | 7/2020 | VanDomelen | |
| 2020/0305551 | A1 | 10/2020 | Campos, II et al. | |
| 2020/0359742 | A1 | 11/2020 | Campos, II et al. | |
| 2020/0390189 | A1 | 12/2020 | Campos, II et al. | |
| 2021/0145118 | A1 | 5/2021 | Campos, II et al. | |
| 2021/0195996 | A1 | 7/2021 | Chan et al. | |
| 2021/0353001 | A1 | 11/2021 | Elder et al. | |
| 2021/0368918 | A1 | 12/2021 | Lyke | |
| 2021/0368922 | A1 | 12/2021 | Ho et al. | |
| 2022/0047040 | A1 | 2/2022 | Durflinger et al. | |
| 2022/0202136 | A1 | 6/2022 | Campos, II et al. | |
| 2022/0378150 | A1 | 12/2022 | Brooks et al. | |
| 2023/0043845 | A1 | 2/2023 | Bandyopadhyay et al. | |
| 2023/0189925 | A1 | 6/2023 | Andreasen et al. | |
| 2023/0301397 | A1 | 9/2023 | Campos, II et al. | |
| 2023/0404210 | A1 | 12/2023 | Connell et al. | |

FOREIGN PATENT DOCUMENTS

| | | | |
|---|---|---|---|
| WO | WO-2016014638 | A1 | 1/2016 |
| WO | WO-2016164559 | A1 | 10/2016 |
| WO | WO-2017079256 | A1 | 5/2017 |
| WO | WO-2021101971 | A1 | 5/2021 |

OTHER PUBLICATIONS

European Patent Office (ISA), International Search Report and Written Opinion for PCT App. No. PCT/US23/68560, mailed Sep. 14, 2023.

Taiwan Intellectual Property Office, Office Action for TW App. No. 112122614, issued Mar. 19, 2024.

European Patent Office (ISA), International Search Report and Written Opinion for PCT App. No. PCT/US2024/034232, mailed Sep. 20, 2024.

USPTO, Non-Final Office Action for U.S. Appl. No. 18/335,699, mailed Nov. 25, 2024.

* cited by examiner

BLADDER FOR AN ARTICLE OF FOOTWEAR

CROSS REFERENCE TO RELATED APPLICATIONS

This application claims priority under 35 U.S.C. § 119(e) to U.S. Provisional Application No. 63/508,427, filed on Jun. 15, 2023. The disclosure of this prior application is considered part of the disclosure of this application and is hereby incorporated by reference in its entirety.

FIELD

The present disclosure relates generally to a fluid-filled chamber and, more particularly, to a fluid-filled chamber for an article of footwear.

BACKGROUND

This section provides background information related to the present disclosure and is not necessarily prior art.

Fluid-filled chambers or bladders are used in articles of footwear to provide cushioning and other performance characteristics during use. Such bladders typically include one or more polymeric films forming an outer layer of the bladder and defining an interior chamber that contains a compressible material, such as a fluid, an elastomeric material, and/or a tensile structure. The fluid and/or elastomeric material provide the bladder with the ability to absorb and cushion forces applied thereto while the tensile member helps maintain a desired shape of the bladder in a relaxed state.

In articles of footwear, bladders are traditionally concealed within a sole structure of the article of footwear to provide cushioning and responsiveness to a wearer during use. Such bladders may be contained within a midsole of the article of footwear and, as a result, are hidden from view. Alternatively, a midsole may include an opening where the bladder is visible at a sidewall of the sole structure. Such openings may be so large, in fact, that the bladder forms a majority of a thickness of the sole structure. In such a configuration, a sidewall of the bladder may extend between and join an upper of the article of footwear and a ground-engaging surface of the article of footwear.

Regardless of the particular structure of the bladder and its relationship to other components of the sole structure, the bladder is often positioned within the sole structure at a specific location to provide a wearer with cushioned support during use. For example, a bladder may be positioned in a heel region of the sole structure to cushion an initial impact of a wearer's foot during a walking or running movement. Alternatively, a bladder may extend from a heel region of the sole structure to a forefoot region of the sole structure to effectively cushion a wearer's foot throughout an entire gait cycle. Such bladders effectively and efficiently absorb forces associated with the wearer's foot impacting a ground surface and, thus, provide the wearer with a degree of comfort and support.

While conventional bladders provide a wearer with a degree of comfort and support during use, a continuous need exists to develop bladders that provide targeted support and response for particular movements and activities.

DRAWINGS

The drawings described herein are for illustrative purposes only of selected configurations and not all possible implementations, and are not intended to limit the scope of the present disclosure.

Figure 1:
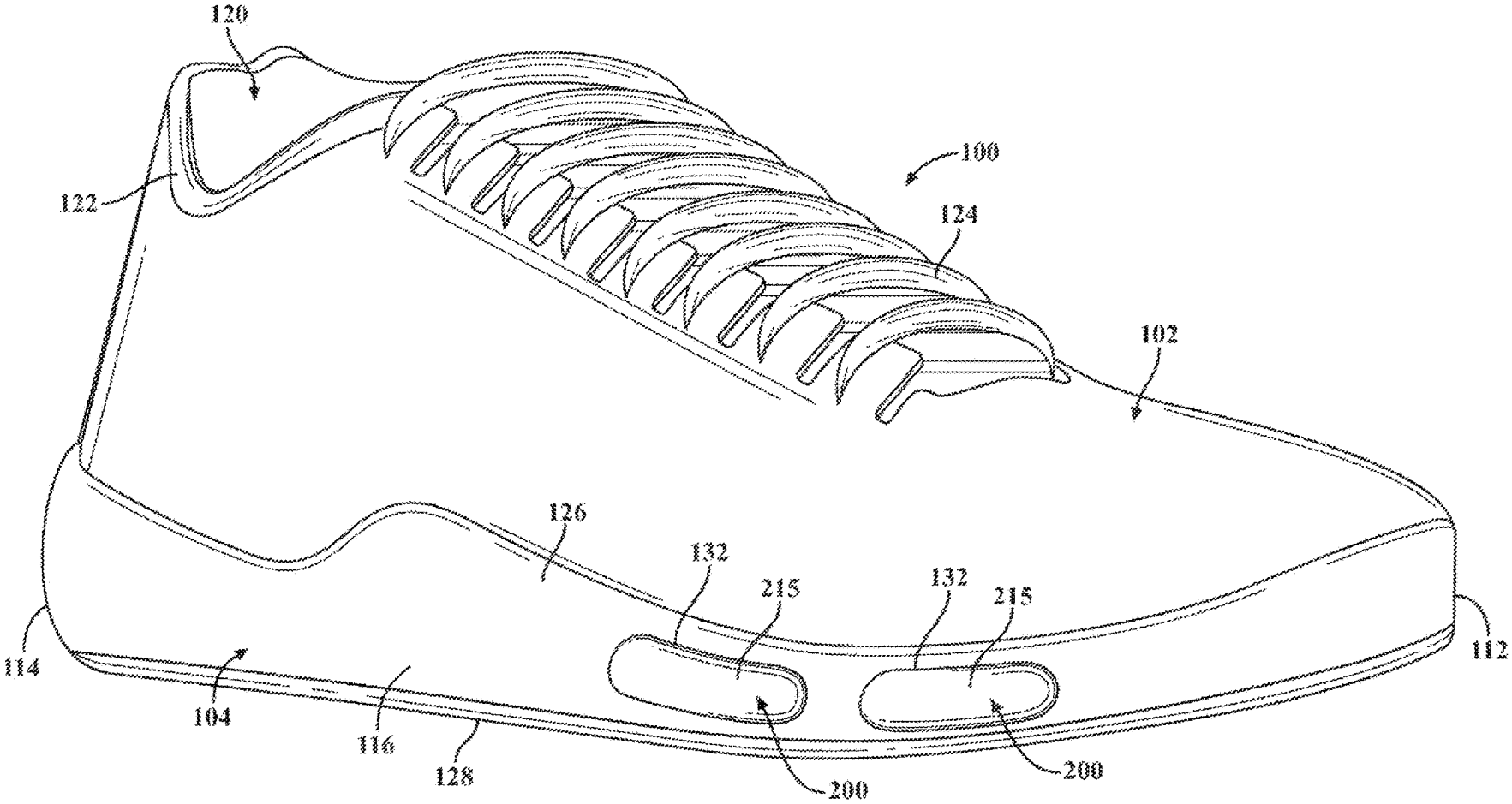
FIG. 1 is a perspective view of an article of footwear comprising a bladder, according to one example.
Figure 7:
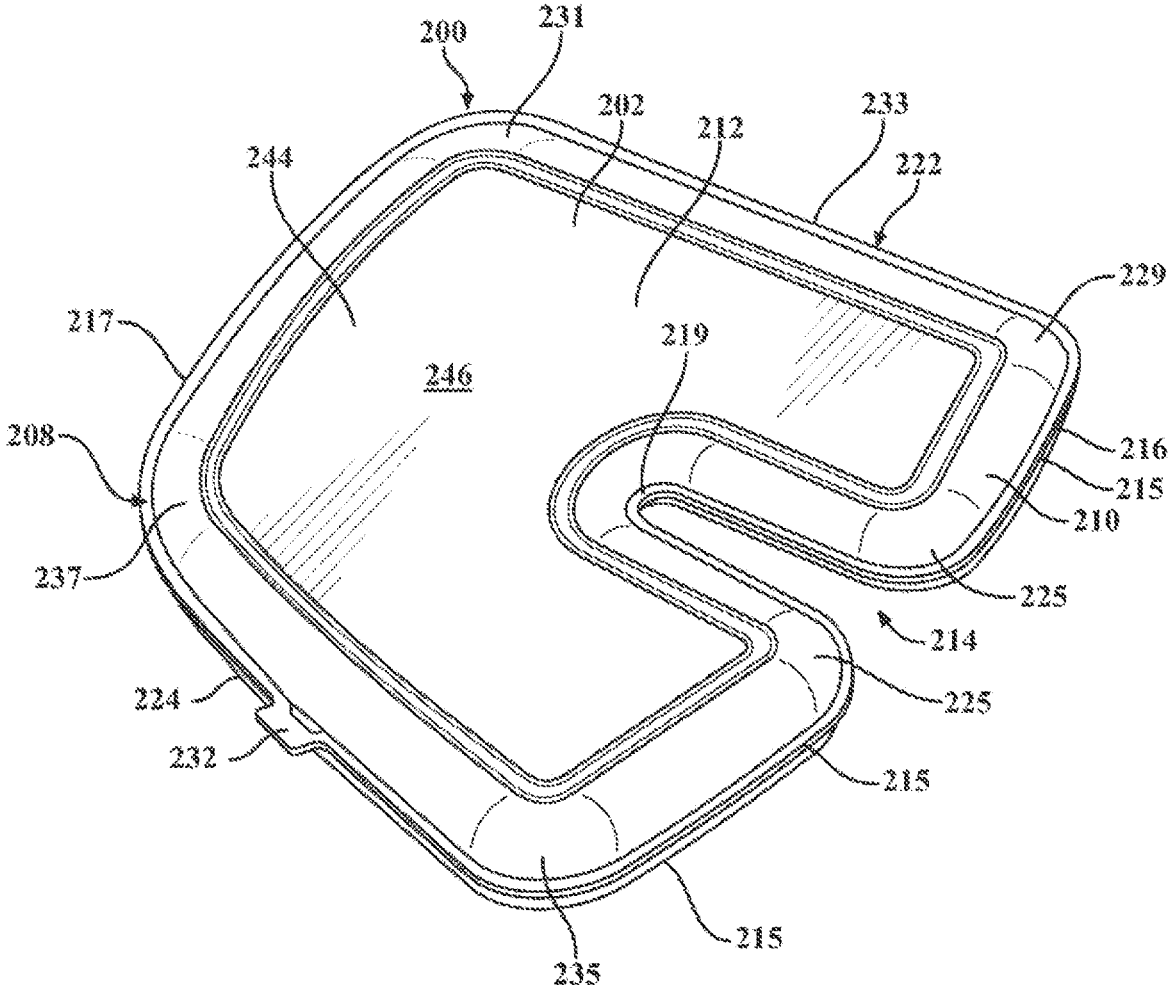
Figure 8:
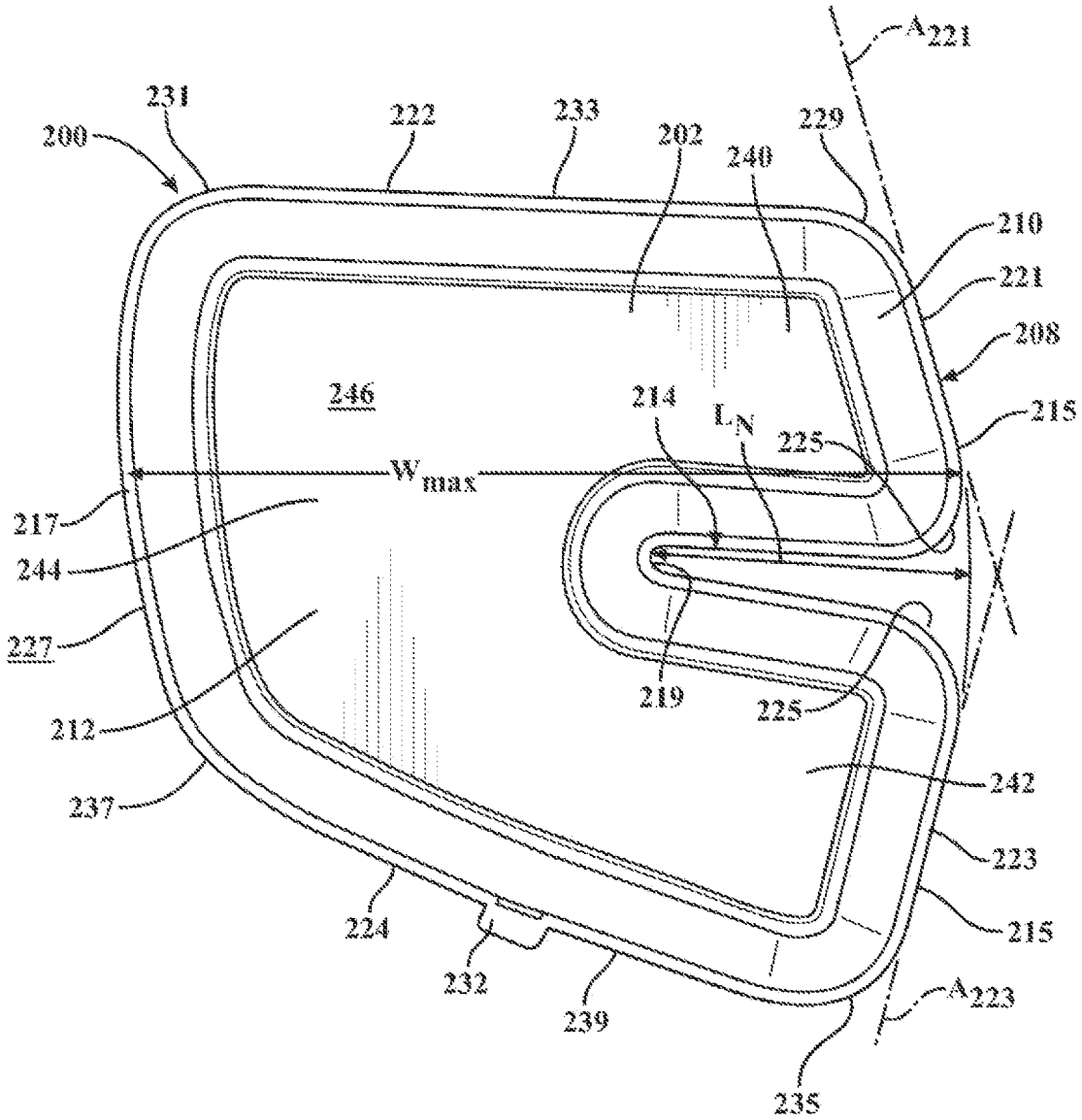
Figure 9:
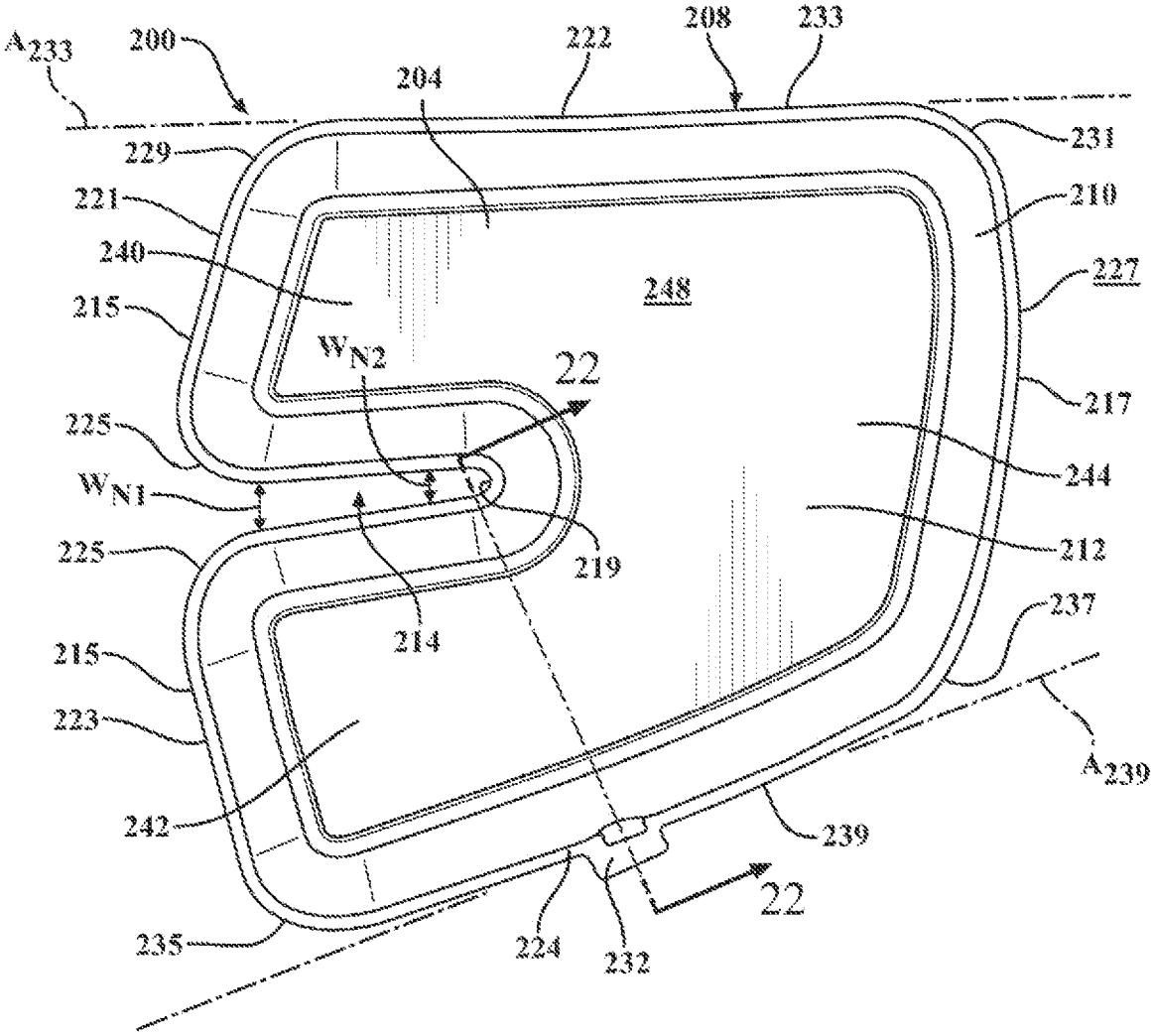
Figure 10:
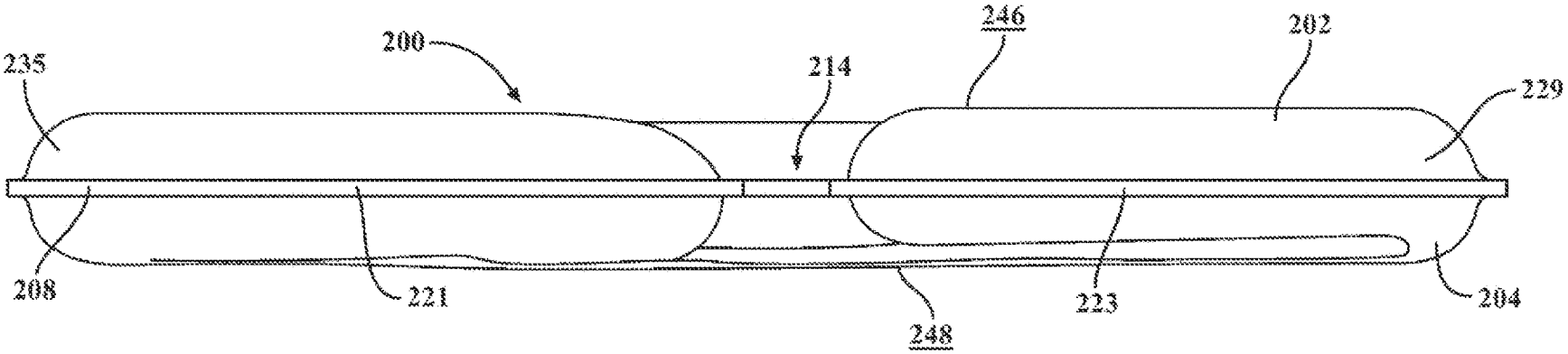
Figure 11:
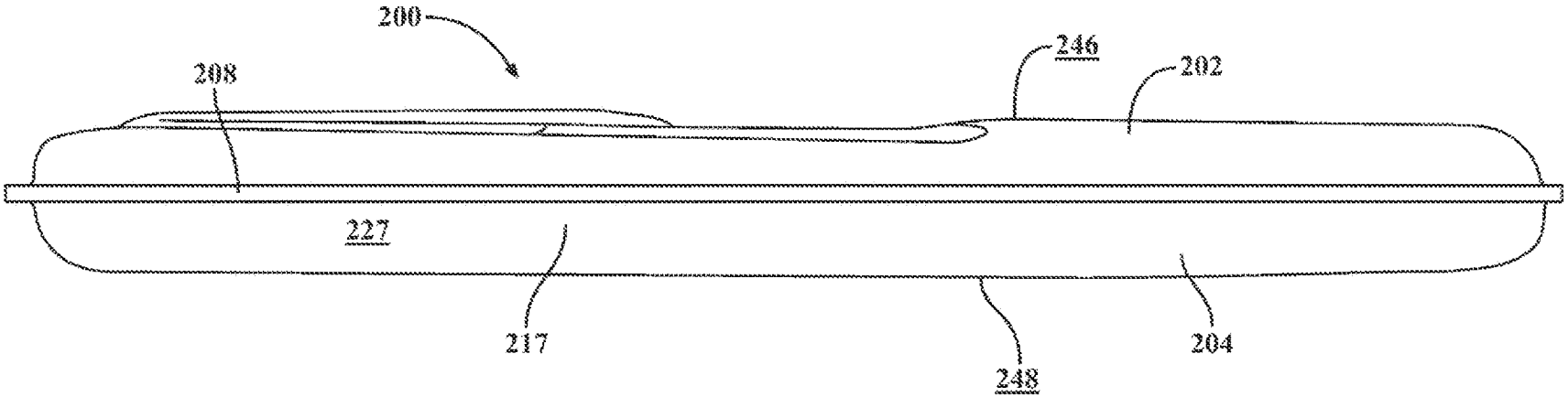
Figure 12:
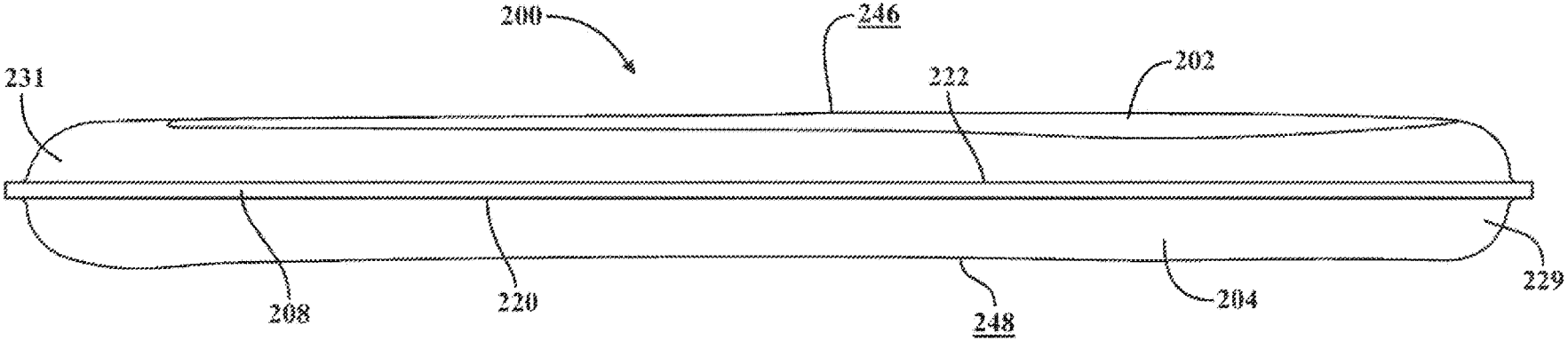
Figure 13:
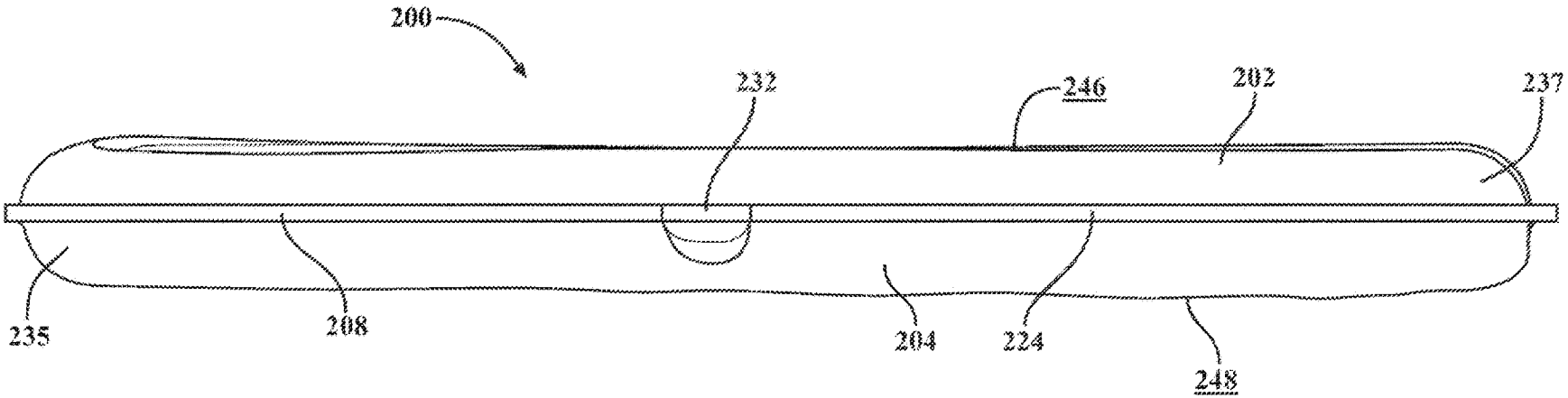
Figure 14:
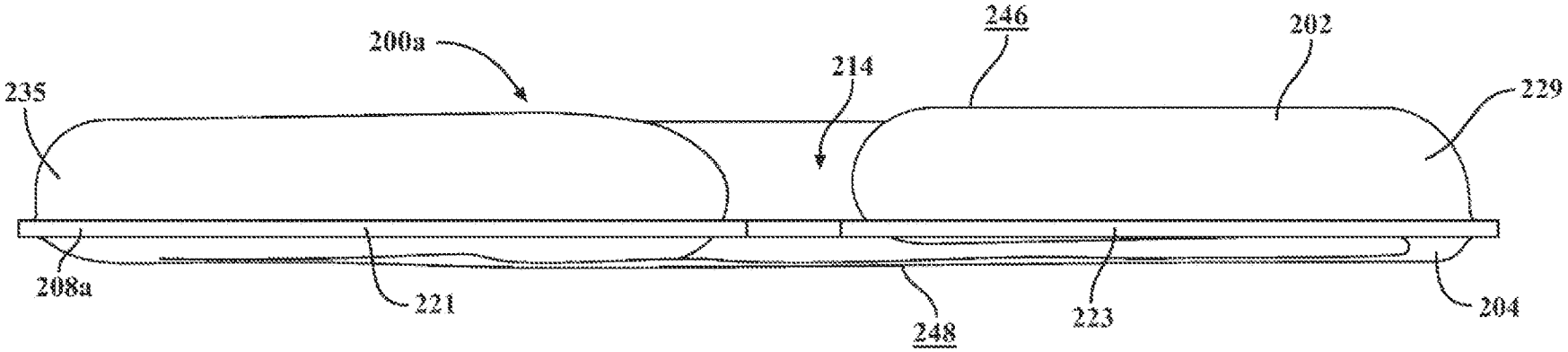
Figure 15:
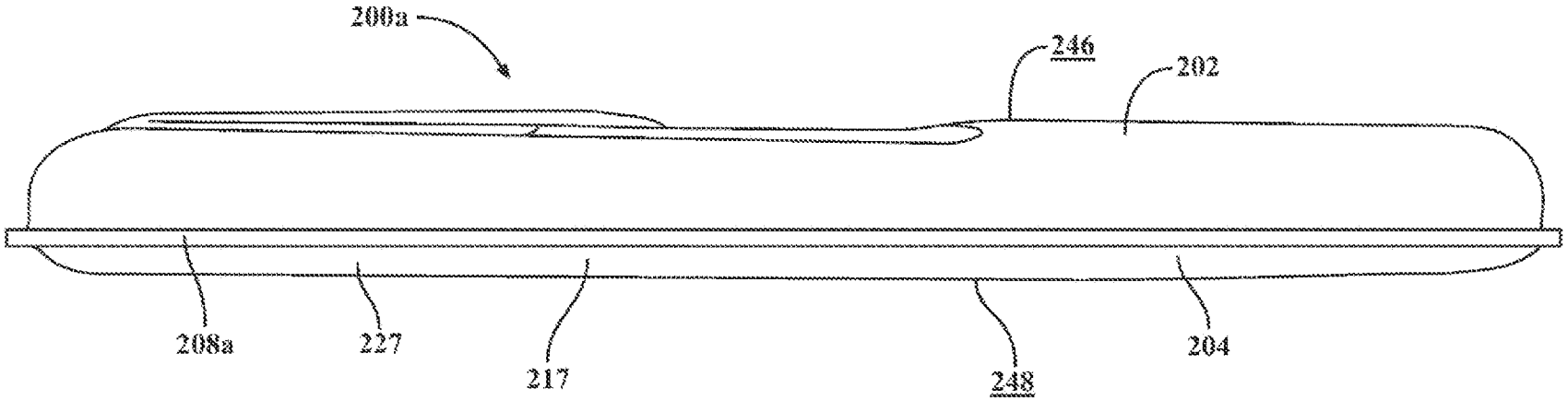
Figure 16:
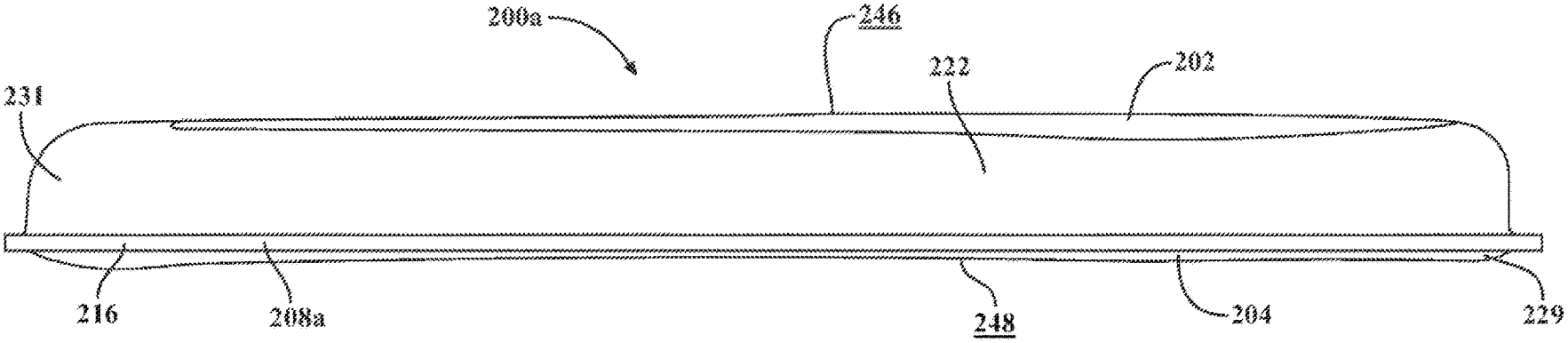
Figure 17:
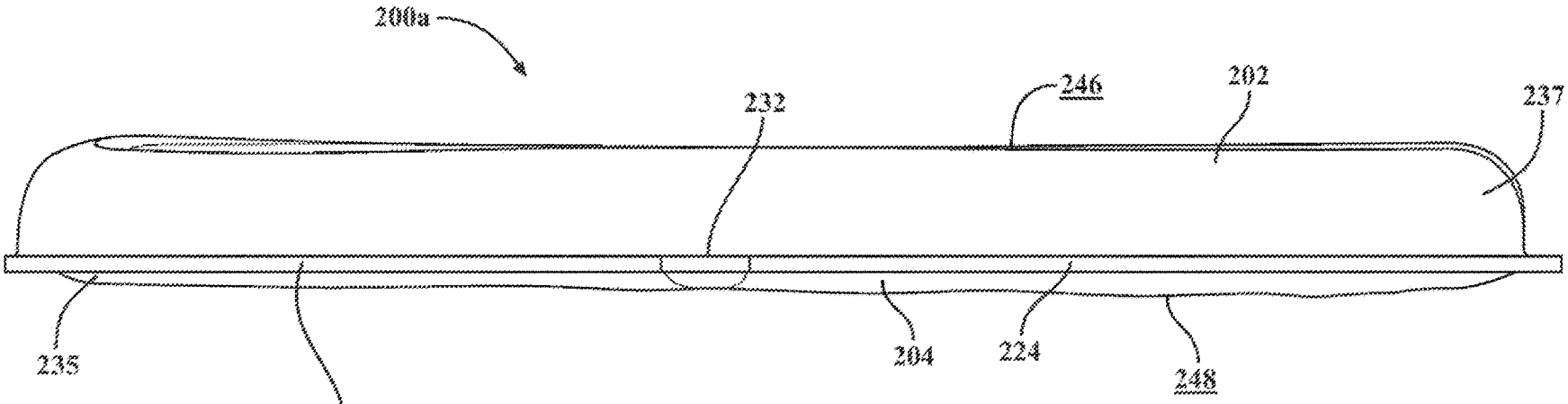
Figure 18:
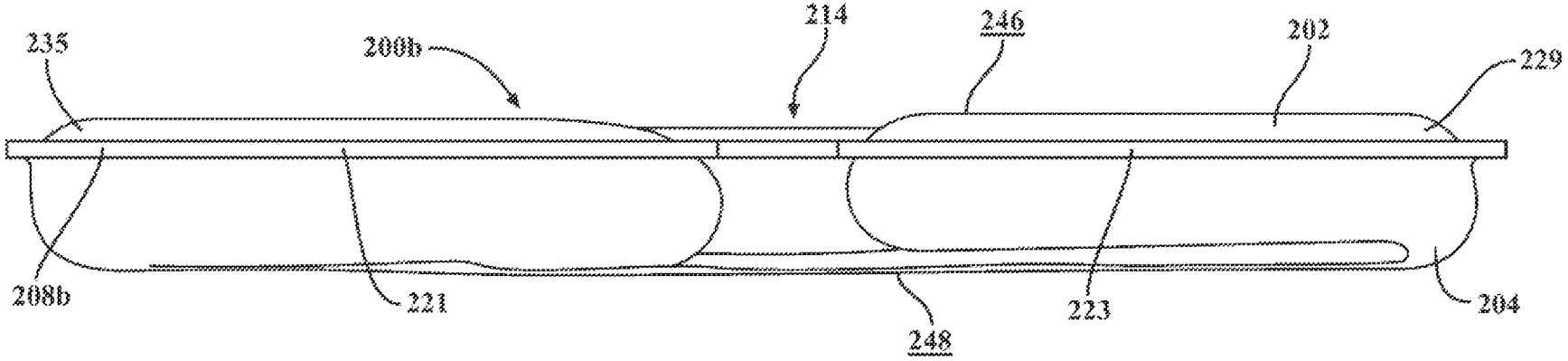
Figure 19:
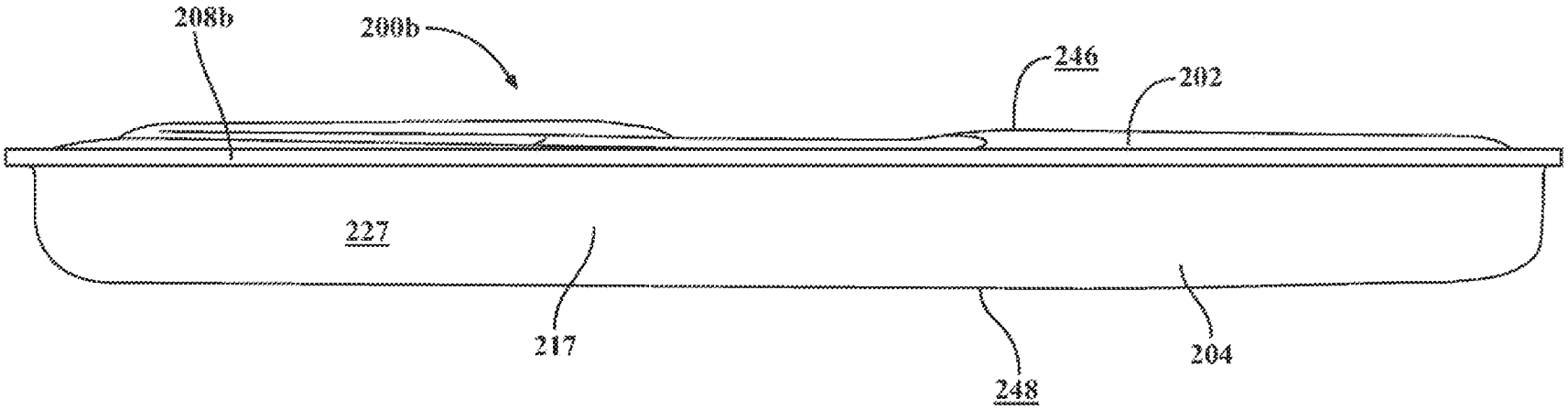
Figure 20:
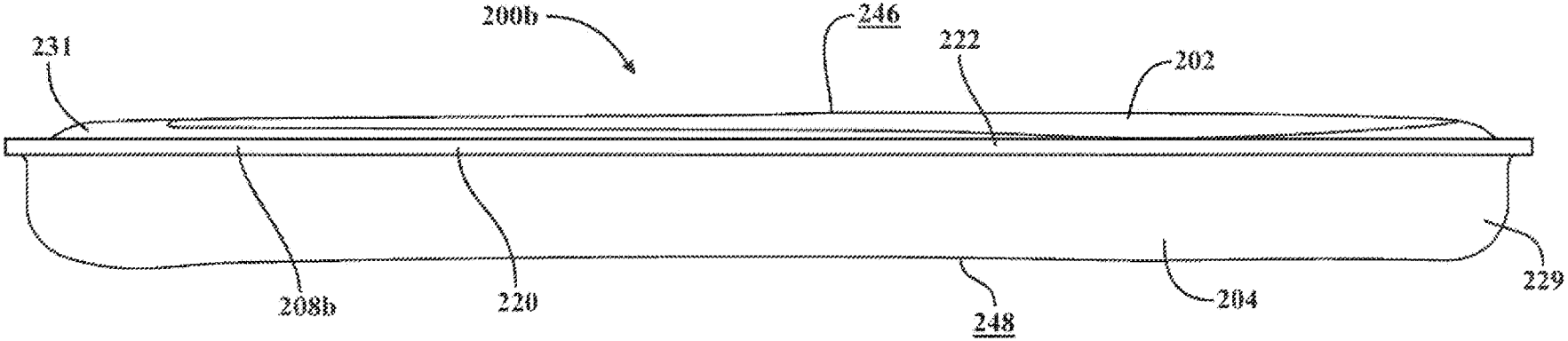
Figure 21:
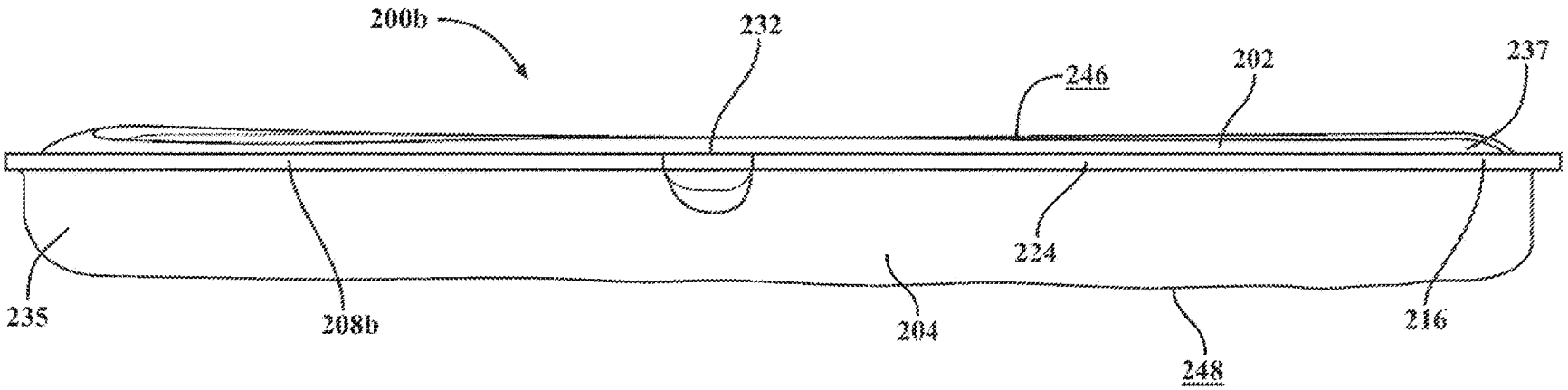
Figure 22:
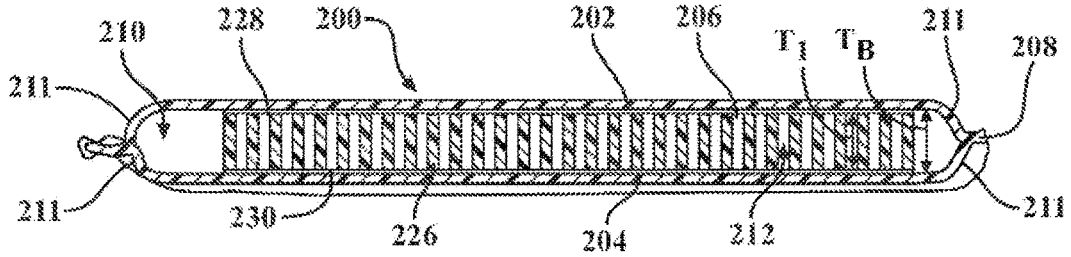
Figure 23:
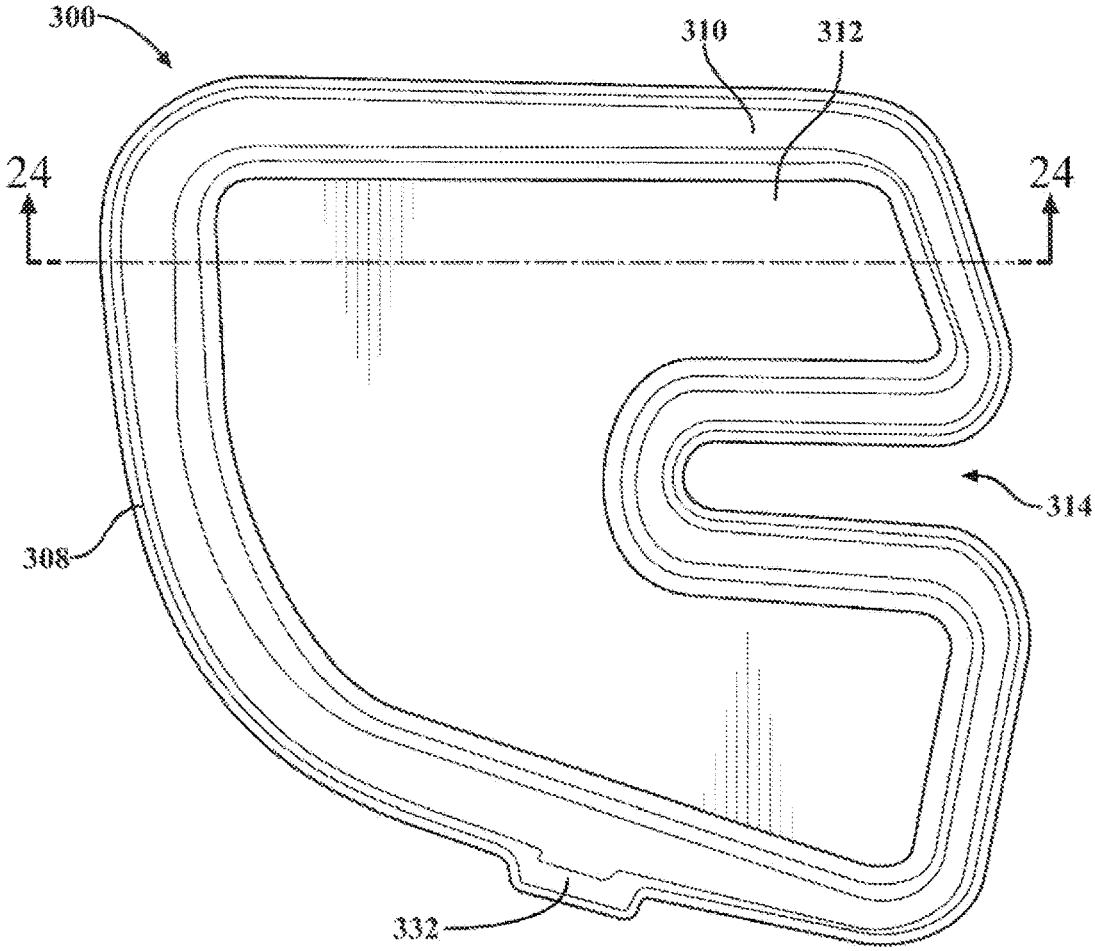
Figure 24:
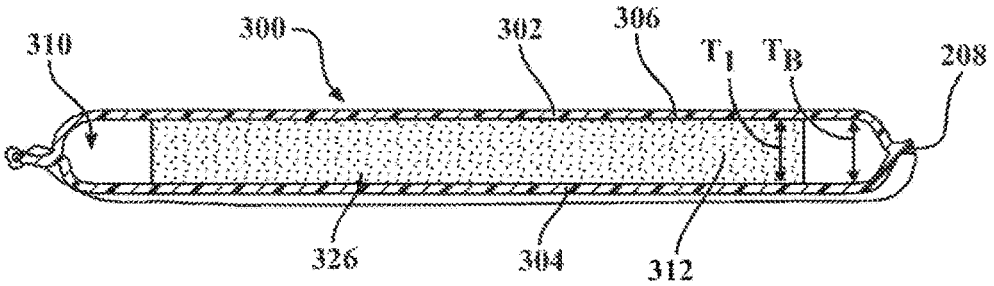

FIG. 7 a perspective view of a bladder of the article of footwear of FIG. 1;

FIG. 8 is a superior side view of the bladder of FIG. 7;

FIG. 9 is an inferior side view of the bladder of FIG. 7;

FIG. 10 is a lateral side view of the bladder of FIG. 7;

FIG. 11 is a medial side view of the bladder of FIG. 7;

FIG. 12 is an anterior side view of the bladder of FIG. 7;

FIG. 13 is a posterior side view of the bladder of FIG. 7;

FIG. 14 is lateral side view of another bladder for use with the article of footwear of FIG. 1;

FIG. 15 is a medial side view of the bladder of FIG. 14;

FIG. 16 is an anterior side view of the bladder of FIG. 14;

FIG. 17 is a posterior side view of the bladder of FIG. 14;

FIG. 18 is a lateral side view of another bladder for use with the article of footwear of FIG. 1;

FIG. 19 is a medial side view of the bladder of FIG. 18;

FIG. 20 is an anterior side view of the bladder of FIG. 18;

FIG. 21 is a posterior side view of the bladder of FIG. 18;

FIG. 22 is a cross-sectional view of the bladder of FIG. 7, taken along line 22-22 of FIG. 9;

FIG. 23 is a superior view of a bladder in a accordance with the principles of the present disclosure; and FIG. 24 is a cross-sectional view of the bladder of FIG. 23, taken along line 24-24 of FIG. 23.

Corresponding reference numerals indicate corresponding parts throughout the drawings.

DETAILED DESCRIPTION

Example configurations will now be described more fully with reference to the accompanying drawings. Example configurations are provided so that this disclosure will be thorough, and will fully convey the scope of the disclosure to those of ordinary skill in the art. Specific details are set forth such as examples of specific components, devices, and methods, to provide a thorough understanding of configurations of the present disclosure. It will be apparent to those of ordinary skill in the art that specific details need not be employed, that example configurations may be embodied in many different forms, and that the specific details and the example configurations should not be construed to limit the scope of the disclosure.

The terminology used herein is for the purpose of describing particular exemplary configurations only and is not intended to be limiting. As used herein, the singular articles "a," "an," and "the" may be intended to include the plural forms as well, unless the context clearly indicates otherwise. The terms "comprises," "comprising," "including," and "having," are inclusive and therefore specify the presence of features, steps, operations, elements, and/or components, but do not preclude the presence or addition of one or more other features, steps, operations, elements, components, and/or groups thereof. The method steps, processes, and operations described herein are not to be construed as necessarily requiring their performance in the particular order discussed or illustrated, unless specifically identified as an order of performance. Additional or alternative steps may be employed.

When an element or layer is referred to as being "on," "engaged to," "connected to," "attached to," or "coupled to" another element or layer, it may be directly on, engaged, connected, attached, or coupled to the other element or layer, or intervening elements or layers may be present. In contrast, when an element is referred to as being "directly on," "directly engaged to," "directly connected to," "directly attached to," or "directly coupled to" another element or layer, there may be no intervening elements or layers present. Other words used to describe the relationship between elements should be interpreted in a like fashion ("between" versus "directly between," "adjacent" versus "directly adjacent," etc.). As used herein, the term "and/or" includes any and all combinations of one or more of the associated listed items.

The terms first, second, third, etc. may be used herein to describe various elements, components, regions, layers and/or sections. These elements, components, regions, layers and/or sections should not be limited by these terms. These terms may be only used to distinguish one element, component, region, layer or section from another region, layer or section. Terms such as "first," "second," and other numerical terms do not imply a sequence or order unless clearly indicated by the context. Thus, a first element, component, region, layer or section discussed below could be termed a second element, component, region, layer or section without departing from the teachings of the example configurations.

In one configuration, a bladder includes a first barrier element, a second barrier element opposing the first barrier element, and a peripheral seam joining the first barrier element and the second barrier element to define a first fluid-filled segment extending from a first side of the bladder to a second side of the bladder, a second fluid-filled segment extending from the first side of the bladder to the second side of the bladder, and a notch extending between and separating distal ends of the first fluid-filled segment and the second fluid-filled segment, the first fluid-filled segment extending along a first axis and the second fluid-filled segment extending along a second axis convergent with the first axis.

The bladder may include one or more of the following optional features. For example, the first fluid-filled may be segment elongate and/or the second fluid-filled may be segment elongate. Additionally or alternatively, the notch may be elongate and may terminate at a terminal end between the first side of the bladder and the second side of the bladder. The terminal end may extend between 10% to 40% of a total width of the bladder from the second side of the bladder toward the first side of the bladder. Further, the notch may extend from an opening located at the second side of the bladder to a terminal end disposed between the first side of the bladder and the second side of the bladder.

In one configuration, the notch may include a substantially constant width. Alternatively, the notch may taper in a direction from the opening toward the terminal end.

The bladder may be pressurized. Additionally or alternatively, the bladder may be incorporated into an article of footwear.

In another configuration, a bladder includes a first barrier element, a second barrier element opposing the first barrier element, and a peripheral seam joining the first barrier element and the second barrier element to define a first fluid-filled segment extending from a first side of the bladder to a second side of the bladder, a second fluid-filled segment extending from the first side of the bladder to the second side of the bladder, and a notch extending between and separating distal ends of the first fluid-filled segment and the second fluid-filled segment, the distal end of the first fluid-filled segment and the distal end of the second fluid-filled segment extending away from one another at the second side of the bladder.

The bladder may include one or more of the following optional features. For example, the first fluid-filled may be segment elongate and/or the second fluid-filled may be segment elongate. Additionally or alternatively, the notch may be elongate and may terminate at a terminal end between the first side of the bladder and the second side of the bladder. The terminal end may extend between 10% to 40% of a total width of the bladder from the second side of the bladder toward the first side of the bladder. Further, the notch may extend from an opening located at the second side of the bladder to a terminal end disposed between the first side of the bladder and the second side of the bladder.

In one configuration, the notch may include a substantially constant width. Alternatively, the notch may taper in a direction from the opening toward the terminal end.

The bladder may be pressurized. Additionally or alternatively, the bladder may be incorporated into an article of footwear.

The details of one or more implementations of the disclosure are set forth in the accompanying drawings and the description below. Other aspects, features, and advantages will be apparent from the description, the drawings, and the claims.

Figure 2:
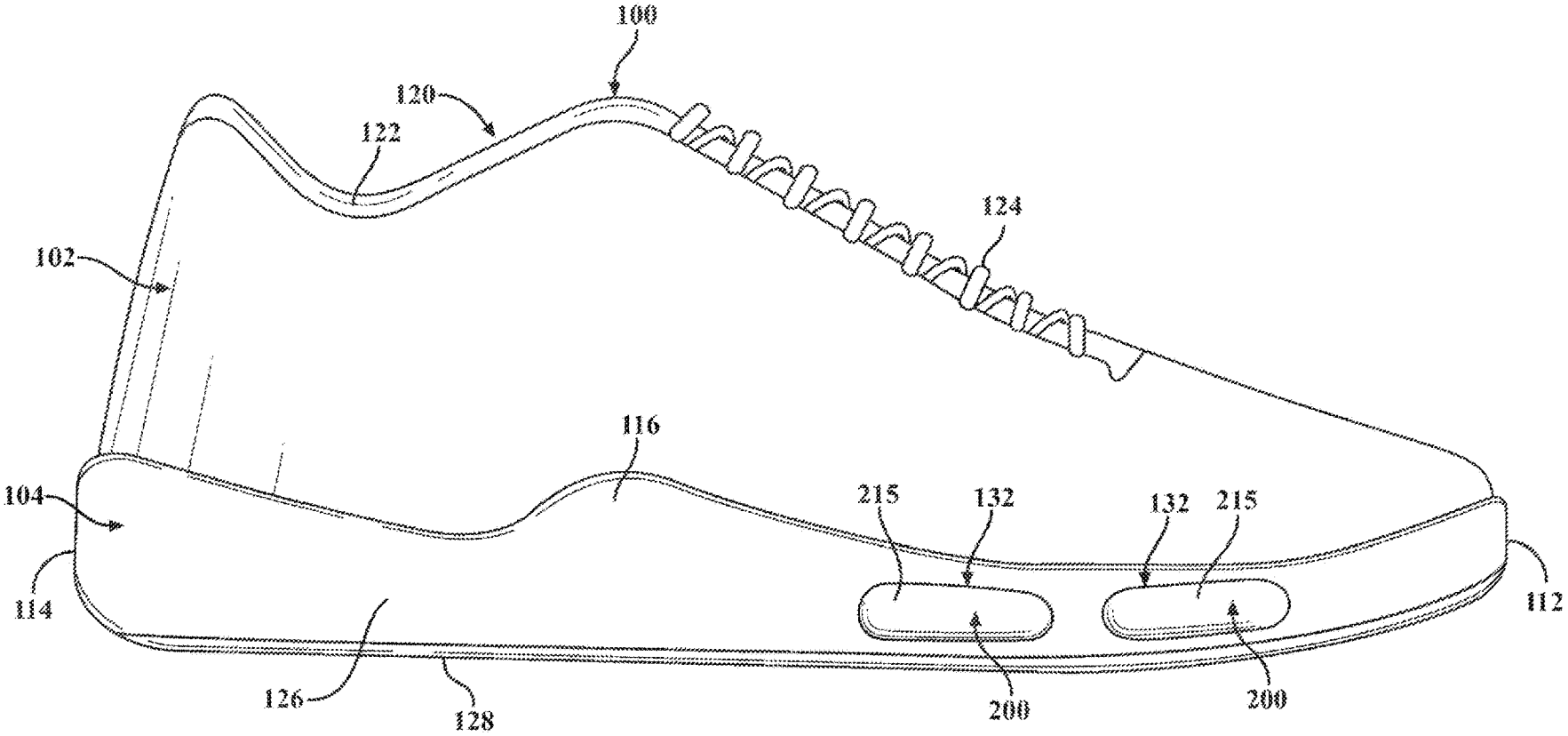
FIG. 2 is a lateral side view of the article of footwear of FIG. 1.
Figure 3:
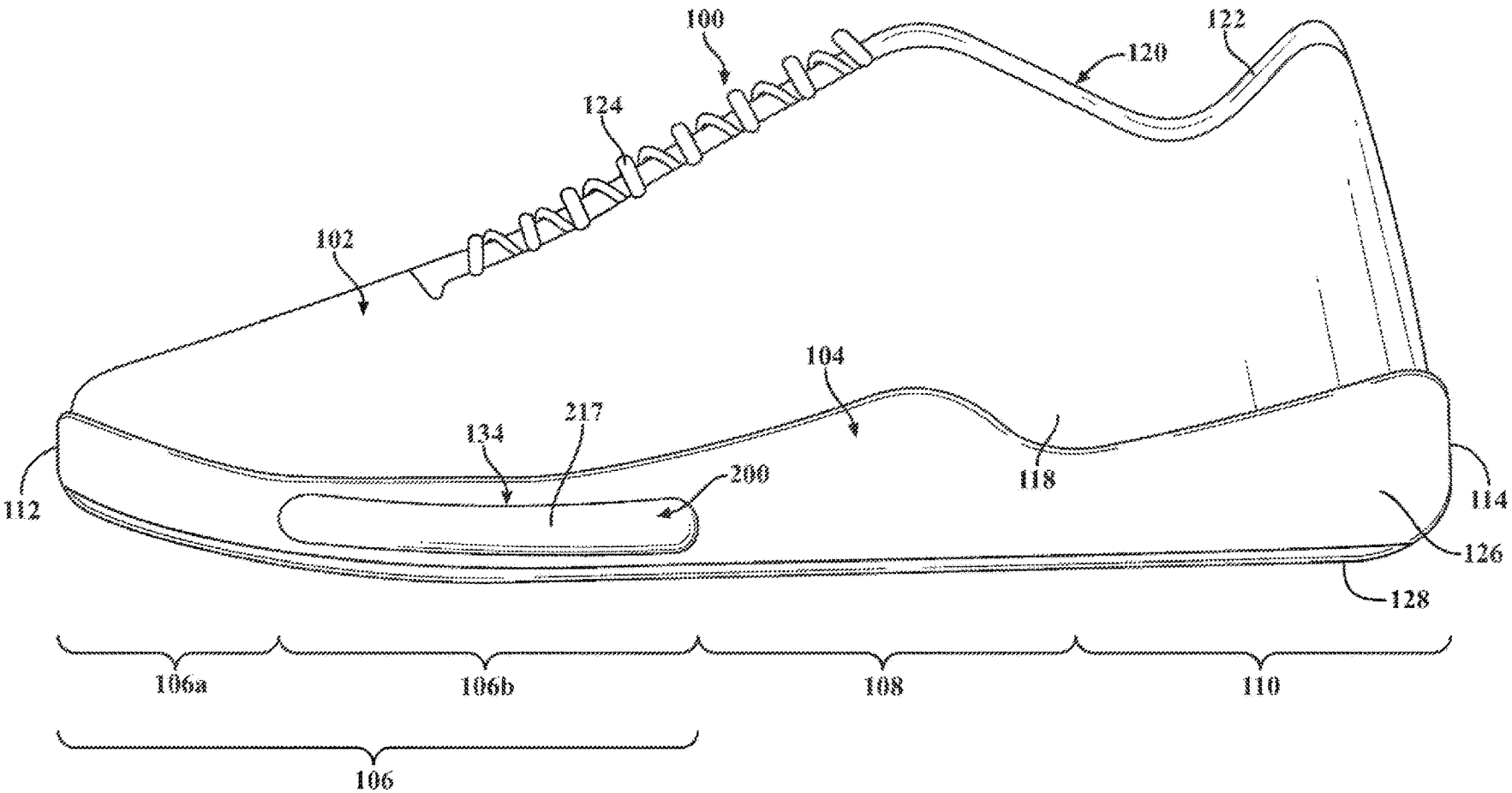
FIG. 3 is a medial side view of the article of footwear of FIG. 1.

FIGS. 1-6 depict an article of footwear 100 in accordance with the principles of the present disclosure. The article of footwear 100 includes an upper 102 and a sole structure 104 and may be divided into one or more regions. Referring to FIG. 3, the regions may include a forefoot region 106, a midfoot region 108, and a heel region 110. The forefoot region 106 may be subdivided into a toe portion **106*a* corresponding with phalanges, and a ball portion 106*b* associated with metatarsal bones of a foot. The midfoot region 108 may correspond with an arch area of the foot while the heel region 110 may correspond with rear portions of the foot, including a calcaneus bone. The footwear 100 may further include an anterior end 112 associated with a forward-most point of the forefoot region 106 and a posterior end 114 associated with a rearward-most point of the heel region 110. A longitudinal axis AF of the footwear 100 extends along a length of the footwear 100 from the anterior end 112 to the posterior end 114, and generally divides the footwear 100 at its widest location into a lateral side 116 and a medial side 118. Accordingly, the lateral side 116 and the medial side 118 respectively correspond with opposite sides of the footwear 100 and extend through the regions 106, 108, 110**.

The upper 102 of the footwear 100 includes interior surfaces that define an interior void 120 configured to receive and secure a foot for support on the sole structure 104. The upper 102 may be formed from one or more materials that are stitched or adhesively bonded together to form the interior void 120. Suitable materials of the upper may include, but are not limited to, mesh, textiles, foam, leather, and synthetic leather. The materials may be selected and located to impart properties of durability, air-permeability, wear-resistance, flexibility, and comfort.

In some examples, the upper 102 includes a strobel 103 (FIG. 5) having a bottom surface opposing the sole structure 104 and an opposing top surface defining a footbed of the interior void 120. Stitching and/or adhesives may secure the strobel 103 to the upper 102 around a bottom, perimeter edge of the upper 102. In one configuration, the footbed may be contoured to conform to a profile of the bottom surface (e.g., plantar) of the foot.

Optionally, the upper 102 may also incorporate additional layers such as an insole or sockliner 105 (FIG. 5) that may be received within the interior void 120 and reside on the strobel 103. The insole 105 may be formed from a pliable material such as, for example, foam and may receive a plantar surface of the foot to enhance the comfort of the article of footwear 100 during wear. An ankle opening 122 in the heel region 110 of the upper 102 may provide access to the interior void 120. For example, the ankle opening 122 may receive a foot to secure the foot within the interior void 120 and facilitate entry and removal of the foot to and from the interior void 120.

In some examples, one or more fasteners 124 are adjustably coupled to the upper 102. The fasteners 124 can be used to adjust a fit of the interior void 120 around the foot and to accommodate entry and removal of the foot therefrom. The fasteners 124 may include laces, straps, cords, hook-and-loop, and/or any other suitable type of fastener. In some instances, the upper 102 may include a tongue portion (not shown) that extends between the interior void 120 and the fasteners 124.

Figure 6:
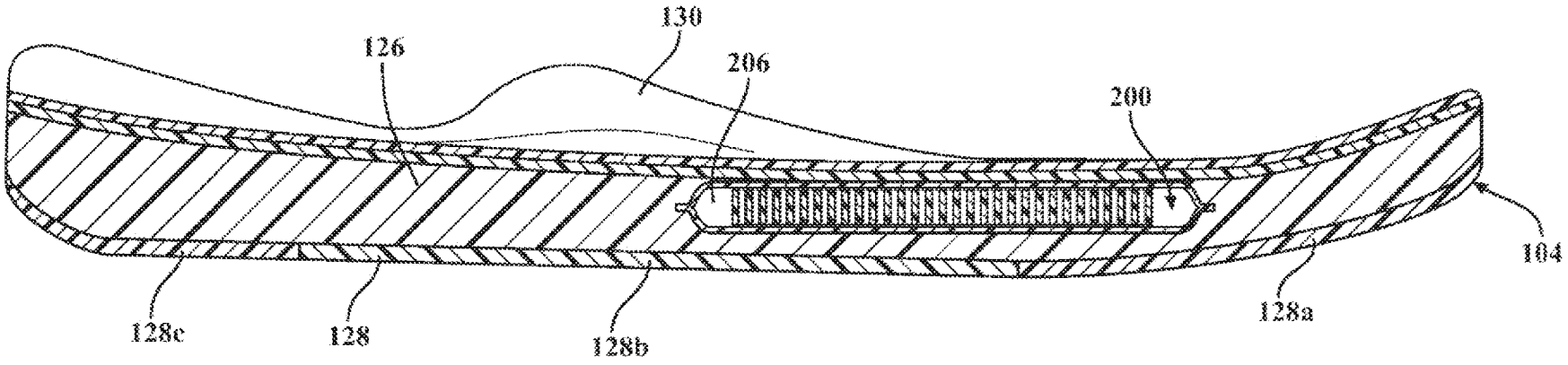
FIG. 6 is a cross-sectional view of the article of footwear of FIG. 1, taken along line 6-6 of FIG. 4.

Referring to FIG. 1, the sole structure 104 of the article of footwear 100 includes a midsole 126 and an outsole 128. The midsole 126 provides cushioning characteristics to the sole structure 104 while the outsole 128 provides a primary ground-engaging surface of the article of footwear 100. In some examples, the midsole 126 and/or the outsole 128 can each comprise a plurality of subcomponents. For example, as shown in FIG. 6, the midsole 126 includes a bladder 200 and a cushioning member 130 that receives the bladder 200. Likewise, and with reference to FIG. 6, the outsole 128 can include one or more segments (e.g., a forefoot segment 128*a*, a midfoot segment 128*b*, and/or a heel segment 128*c*). The subcomponents of the outsole 128 can be secured to one another or may be individually attached to the midsole 126 such that each segment 128*a* 128*b*, 128*c* of the outsole 128 is individually attached to the midsole 126 and is independent from at least one of the other segments 128*a*, 128*b*, 128*c* of the outsole 128.

FIGS. 7-13 and 22 depict the bladder 200 of the midsole 126. Referring to FIG. 22, the bladder 200 includes an opposing pair of barrier elements 202, 204 that can be joined to each other at discrete locations to define a chamber 206 and a peripheral seam 208. In the illustrated configuration, the barrier elements 202, 204 include a first, superior barrier element 202 (e.g., an "upper barrier element 202" when disposed within the midsole 126) and a second, inferior barrier element 204 (e.g., a "lower barrier element 204" when disposed within the midsole 126). While the chamber 206 is described as being formed from two barrier elements 202, 204, the chamber 206 could be formed from any suitable combination of one or more barrier layers. For example, the chamber 206 could be formed by folding a single sheet on itself and joining the folded sheet into the shape shown in FIG. 8 by welding or otherwise attaching opposing portions of the sheet to one another in the shape shown in FIG. 8 at the peripheral seam 208. As shown, the chamber 206 is generally defined as the space between the barrier elements 202, 204, while the peripheral seam 208 defines an outer periphery of the bladder 200. The peripheral seam 208 is formed by attaching opposing portions of the barrier elements 202, 204 together by welding or adhesively bonding the elements 202, 204 at the location of the peripheral seam 208. If welding the elements 202, 204 together, heat and/or pressure may be applied to the elements 202, 204 by a suitable process such as, for example, radio frequency (RF) welding to cause a material of the elements 202, 204 to flow and meld together.

As used herein, the term "barrier layer" (e.g., the barrier elements 202, 204) encompasses both monolayer and multilayer films. In some configurations, one or both of barrier elements 202, 204 are each produced (e.g., thermoformed or blow molded) from a monolayer film (a single layer). In other configurations, one or both of barrier elements 202, 204 are each produced (e.g., thermoformed or blow molded) from a multilayer film (multiple sublayers). In either instance, each layer or sublayer can have a film thickness ranging from about 0.2 micrometers to about 1 millimeter. In further configurations, the film thickness for each layer or sublayer can range from about 0.5 micrometers to about 500 micrometers. In yet further configurations, the film thickness for each layer or sublayer can range from about 1 micrometer to about 100 micrometers.

In some examples, the lower barrier element 204 may have a greater thickness than the upper barrier element 202, whereby the lower barrier element 204 is configured to provide a portion of the ground-contacting surface of the article of footwear 100. In some instances, one or more segments 128*a*, 128*b*, 128*c* of the outsole 128 may be integrally formed as part of the lower barrier element 204.

One or both of the barrier elements 202, 204 can independently be transparent, translucent, and/or opaque. For example, the upper barrier element 202 may be transparent, while the lower barrier element 204 is opaque. As used herein, the term "transparent" for a barrier layer and/or a fluid-filled chamber means that light passes through the barrier layer in substantially straight lines and a viewer can see through the barrier layer. In comparison, for an opaque barrier layer, light does not pass through the barrier layer, and one cannot see clearly through the barrier layer at all. A translucent barrier layer falls between a transparent barrier layer and an opaque barrier layer. Light passes through a translucent layer but some of the light is scattered so that a viewer cannot see clearly through the layer.

Barrier elements 202, 204 can each be produced from an elastomeric material that includes one or more thermoplastic polymers and/or one or more cross-linkable polymers. In some instances, the elastomeric material can include one or more thermoplastic elastomeric materials, such as one or more thermoplastic polyurethane (TPU) copolymers, one or more ethylene-vinyl alcohol (EVOH) copolymers, and the like.

As used herein, the term "polyurethane" refers to a copolymer (including oligomers) that contains a urethane group (—N(C═O)O—). These polyurethanes can contain additional groups such as ester, ether, urea, allophanate, biuret, carbodiimide, oxazolidinyl, isocynaurate, uretdione, carbonate, and the like, in addition to urethane groups. In some instances, one or more of the polyurethanes can be produced by polymerizing one or more isocyanates with one or more polyols to produce copolymer chains having (—N(C═O)O—) linkages.

Examples of suitable isocyanates for producing the polyurethane copolymer chains include diisocyanates, such as aromatic diisocyanates, aliphatic diisocyanates, and combinations thereof. Examples of suitable aromatic diisocyanates include toluene diisocyanate (TDI), TDI adducts with trimethyloylpropane (TMP), methylene diphenyl diisocyanate (MDI), xylene diisocyanate (XDI), tetramethylxylylene diisocyanate (TMXDI), hydrogenated xylene diisocyanate (HXDI), naphthalene 1,5-diisocyanate (NDI), 1,5-tetrahydronaphthalene diisocyanate, para-phenylene diisocyanate (PPDI), 3,3'-dimethyldiphenyl-4,4'-diisocyanate (DDDI), 4,4'-dibenzyl diisocyanate (DBDI), 4-chloro-1,3-phenylene diisocyanate, and combinations thereof. In some configurations, the copolymer chains are substantially free of aromatic groups.

In particular instances, the polyurethane polymer chains are produced from diisocynates including HMDI, TDI, MDI, H12 aliphatics, and combinations thereof. In an aspect, the thermoplastic TPU can include polyester-based TPU, polyether-based TPU, polycaprolactone-based TPU, polycarbonate-based TPU, polysiloxane-based TPU, or combinations thereof.

In other instances, the polymeric layer can be formed of one or more of the following: EVOH copolymers, poly (vinyl chloride), polyvinylidene polymers and copolymers (e.g., polyvinylidene chloride), polyamides (e.g., amorphous polyamides), amide-based copolymers, acrylonitrile polymers (e.g., acrylonitrile-methyl acrylate copolymers), polyethylene terephthalate, polyether imides, polyacrylic imides, and other polymeric materials known to have relatively low gas transmission rates. Blends of these materials as well as with the TPU copolymers described herein and optionally including combinations of polyimides and crystalline polymers, are also suitable.

The barrier elements 202, 204 may include two or more sublayers (multilayer film) such as described in U.S. Pat. Nos. 5,713,141 and 5,952,065, which are incorporated by reference herein. In examples where the barrier elements 202, 204 include two or more sublayers, examples of suitable multilayer films include microlayer films such as those disclosed in U.S. Pat. No. 6,582,786, which is incorporated by reference herein. In further examples, the barrier elements 202, 204 may each independently include alternating sublayers of one or more TPU copolymer materials and one or more EVOH copolymer materials, where the total number of sublayers in each of barrier elements 202, 204 includes at least four sublayers, at least ten sublayers, at least twenty sublayers, at least forty sublayers, and/or at least sixty sublayers.

The chamber 206 can be produced from barrier elements 202, 204 using any suitable technique, such as thermoforming (e.g., vacuum thermoforming), blow molding, extrusion, injection molding, vacuum molding, rotary molding, transfer molding, pressure forming, heat sealing, casting, low-pressure casting, spin casting, reaction injection molding, radio frequency (RF) welding, and the like. In some examples, the barrier elements 202, 204 can be produced by co-extrusion followed by vacuum thermoforming to produce the chamber 206, which can optionally include one or more valves (e.g., one-way valves) that allows the chamber 206 to be filled with the fluid (e.g., gas). Additional details regarding forming the chamber 206 are provided below.

The chamber 206 can be provided in a fluid-filled (e.g., as provided in the footwear 100) or in an unfilled state. The chamber 206 can be filled to include any suitable fluid, such as a gas or liquid. In an aspect, the gas can include air, nitrogen (N2), or any other suitable gas. In other instances, the chamber 206 can alternatively include other media, such as pellets, beads, ground recycled material, and the like (e.g., foamed beads and/or rubber beads). The fluid provided to the chamber 206 can result in the chamber 206 being pressurized. Alternatively, the fluid provided to the chamber 206 can be at atmospheric pressure such that the chamber 206 is not pressurized but, rather, contains a volume of fluid at atmospheric pressure.

The chamber 206 desirably has a low gas transmission rate to preserve its retained gas pressure. In some examples, the chamber 206 has a gas transmission rate for nitrogen gas that is at least about ten times lower than a nitrogen gas transmission rate for a butyl rubber layer of substantially the same dimensions. In particular instances, the chamber 206 has a nitrogen gas transmission rate of 15 cubic-centimeter/square-meter-atmosphere-day (cm3/m2·atm·day) or less for an average film thickness of 500 micrometers (based on thicknesses of barrier elements 202, 204). In further instances, the transmission rate is 10 cm3/m2·atm·day or less, 5 cm3/m2·atm·day or less, or 1 cm3/m2·atm·day or less.

In some implementations, the upper barrier element 202 and the lower barrier element 204 cooperate to define a geometry (e.g., thicknesses, width, and lengths) of the chamber 206. For example, the peripheral seam 208 may cooperate to bound and extend around the chamber 206 to seal the fluid (e.g., air) within the chamber 206. Thus, the chamber 206 is associated with an area of the bladder 200 where interior surfaces of the upper and lower barrier elements 202, 204 are separated from one another.

The space formed between opposing interior surfaces of the upper and lower barrier elements 202, 204 defines an interior void of the chamber 206. Similarly, the exterior surfaces of the upper and lower barrier elements 202, 204 define an exterior profile of the chamber 206. Accordingly, the upper and lower barrier elements 202, 204 define respective upper and lower surfaces of the bladder 200.

As shown in FIGS. 7 and 22, the chamber 206 comprises a border portion 210 (which can also be called "an accumulator portion") and an interior portion 212. The border portion 210 and the interior portion 212 are in fluid communication with one another. The border portion 210 is disposed adjacent to the peripheral seam 208 and extends inwardly toward the interior portion 212. In one configuration, the border portion 210 has a thickness TB that is greater than a thickness TI of the interior portion 212. In other configurations, the thickness of the bladder 200 is substantially the same at the border portion 210 and at the interior portion 212, as shown in FIG. 22. In this configuration, and as shown in FIG. 22, thickness TB is substantially equal to thickness TI.

When assembled within the sole structure 104, the border portion 210 of the bladder 200 (i.e., an outer, peripheral edge of the bladder 200) may be at least partially exposed along a peripheral edge of the sole structure 104. For example, as depicted in FIGS. 1-3, the border portion 210 is exposed along the lateral side 116 and the medial side 118 of the sole structure 104. While the bladder 200 is described and shown as including a border portion 210 that is exposed at the peripheral edge of the sole structure 104, the bladder 200 could alternatively be disposed entirely within the sole structure 104 such that the bladder 200 is not visible at an exterior of the sole structure 104. Further, while the bladder 200 is shown as being exposed at both of the medial side 116 and the lateral side 118, the bladder 200 could only be exposed at one of the medial side 116 and the lateral side 118.

Referring to FIG. 22, the border portion 210 of the chamber 206 has curved, outwardly facing surfaces. Namely, the outer, peripheral edge of the border portion 210 includes arcuate surfaces 211 that meet at the peripheral seam 208. As such, the border portion 210 comprises a generally D-shaped cross-sectional profile when viewed from the perspective depicted in FIG. 22. In other examples, the border portion 210 can comprise various other cross-sectional profiles (e.g., rectangular, ovular, circular, and/or other standard or non-standard geometric shapes). The interior portion 212 of the chamber 206 comprises a generally rectangular cross-sectional profile. In the depicted example, the border portion and the interior portion each have substantially uniform thicknesses and uniform shapes throughout. In other examples, the border portion and the interior portion each have non-uniform thicknesses and non-uniform shapes throughout.

Figure 4:
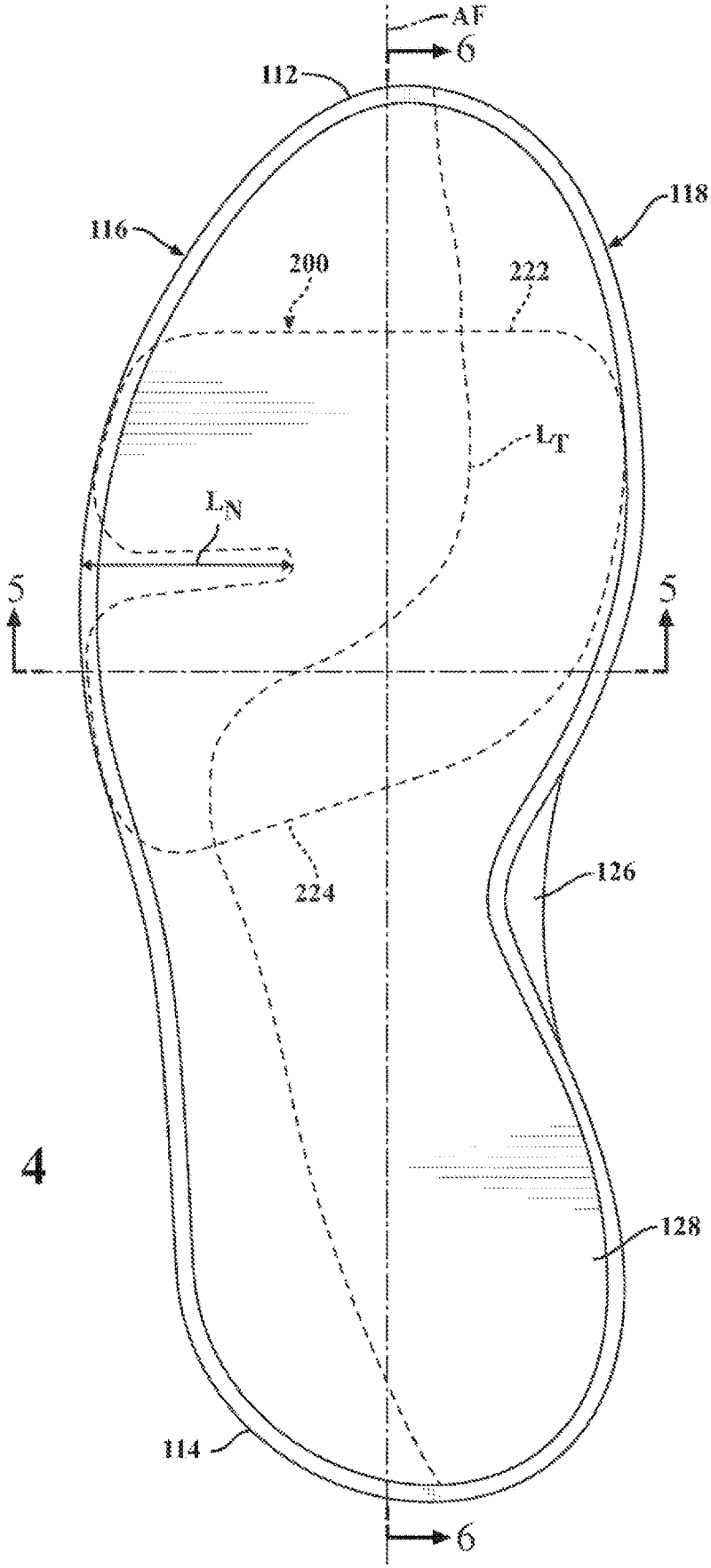
FIG. 4 is a bottom view of a sole structure of the article of footwear of FIG. 1.

Referring now to FIG. 8, the bladder 200 may include a notch 214. The notch 214 extends inwardly from a lateral edge 215 of the bladder 200 toward a medial edge 217 of the bladder 200 to form a channel in the bladder 200. The terms "medial" and "lateral" are used to designate the position of the edges 215, 217 when the bladder 200 is incorporated into the sole structure 104, as shown in FIG. 4. The edges 215, 217, as shown in FIG. 4, are disposed on opposite sides of the bladder 200 from one another. As such, the notch 214 extends into the bladder 200 from a first edge 215 and in a direction toward an opposite side of the bladder (i.e., toward a second edge 217 formed on an opposite side of the bladder 200 than the first edge 215). While the notch 214 will be described hereinafter and shown in the drawings as extending from the lateral edge 215 in a direction toward the medial edge 217, the notch 214 could alternatively extend from the medial edge 217 in a direction toward the lateral edge 215.

The notch 214 is positioned within the bladder 200 in an effort to improve the flexibility of the bladder 200 and, thus, improve the flexibility of the sole structure 104 and footwear 100 incorporating the bladder 200. In some instances, the notch 214 can increase the flexibility of the bladder by up to 50%. In particular instances, the notch 214 can increase the flexibility of the bladder 200 by 35-45%. The notch 214 may be aligned with the ball portion of a wearer's foot (e.g., in the metatarsal head region) and can, for example, allow the bladder 200 to articulate (e.g., flex, pivot, etc.) with the wearer's foot. In particular instances, the notch 214 may be aligned with (e.g., at least partially longitudinally overlap) the first metatarsal head of the wearer's foot. In other instances, the notch 214 may be aligned with the second metatarsal head of the wearer's foot. In other instances, the notch 214 may be aligned with the third metatarsal head of the wearer's foot. In other instances, the notch 214 may be aligned with the fourth metatarsal head of the wearer's foot. In other instances, the notch 214 may be aligned with the fifth metatarsal head of the wearer's foot.

In some examples, the notch 214 may include a substantially uniform width. In such examples, the notch 214 includes a first width WN1 adjacent to the lateral edge 215 of the bladder 200 and a second width WN2 proximate to a terminal end 219 of the notch 214. In this configuration, the widths WN1 and WN2 are approximately equal to one another such that the first width WN1 and the second width WN2 are within 3% of one another. In this manner, the notch 214 comprises a substantially "U" shape. The first width WN1 and the second width WN2 are measured between radii of curvature where the edges of the bladder 200 defining the notch 214 extend at least substantially in a medial/lateral direction. In other examples, the notch 214 may include a non-uniform width. In such examples, the first width WN1 and the second width WN2 differ by more than 3%, as shown in FIGS. 8 and 9. In these cases, the notch 214 comprises a substantially "V" or "tapered" shape. When the notch 214 is tapered, the notch 214 tapers in a direction from the lateral edge 215 toward the terminal end 219 such that the notch 214 decreases in width from the lateral edge 215 to the terminal end 219 (i.e., in a direction from the lateral edge 215 toward the medial edge 217). Such tapering can be constant, as shown in FIGS. 8 and 9, or can vary along the length of the notch 214 from the lateral edge 215 to the terminal end 219. In other instances, the notch 214 can comprise various other shapes and/or widths.

The notch 214 comprises a length LN defined as a straight-line distance from an opening of the notch 214 at the lateral edge 215 to the terminal end 219. In the event that the medial and/or lateral edges are curves, the length LN can be the distance between tangent lines intersecting the curves.

The length LN of the notch 214 can be selected such that the notch 214 (e.g., the terminal end 219 of the notch 214) does not intersect a transition line LT extending along a length of the sole structure 104, as depicted in FIG. 4. The transition line LT represents a primary path of force along the length of the sole structure 104 as a wearer's foot moves from heel to toe during linear movements (e.g., walking, jogging, etc.). Spacing the notch 214 apart from the transition line LT, allows the notch 214 to improve the overall flexibility of the bladder 200 without decreasing the support provided by the bladder 200 during walking and running movements. Further, preventing the notch 214 from crossing the transition line LT reduces the extent to which a wearer might feel the notch 214 under foot during use, thereby increasing the comfort of the wearer.

In some examples, the length LN of the notch 214 can be less than 50% of a max width Wmax of the bladder 200 (FIG. 8). In some examples, the length LN of the notch 214 can be less than 40% of the max width Wmax of the bladder 200. In some examples, the length LN of the notch 214 can be less than 30% of the max width Wmax of the bladder 200. In some examples, the length LN of the notch 214 can be less than 20% of the max width Wmax of the bladder 200. In particular examples, the length LN of the notch 214 can be within a range of 10-50% of the max width Wmax of the bladder 200. In certain examples, the length LN of the notch 214 can be within a range of 20-40% of the max width Wmax of the bladder 200.

In addition to configuring the notch 214 of the bladder 200 such that it is spaced from the transition line LT, in some examples, the border portion 210 of the bladder 200 that defines the notch 214 can have a reduced thickness compared to other locations of the border portion 210 (e.g., the lateral edge 215 and the medial edge 217). Reducing the thickness of the border portion 210 around the notch 214 (e.g., to a thickness equal to or less than the thickness TI of the interior portion) can, for example, improve the feel of the bladder 200 under the wearer's foot.

As shown in FIGS. 8 and 9, the lateral edge 215 and the medial edge 217 are disposed on opposite sides of the bladder 200 and are spaced apart from one another by an anterior edge 222 and a posterior edge 224. The terms "anterior" and "posterior" refer to the positions of the bladder 200 when incorporated into the sole structure 104. Namely, the anterior edge 222 is disposed proximate to the anterior end 112 within the forefoot region 106 while the posterior edge 224 is disposed between the anterior edge 222 and the posterior end 114 and is located within the forefoot region 106 and the midfoot region 108. While these edges 222, 224 will be described hereinafter as being an anterior edge 222 and a posterior edge 224, these edges 222, 224 could alternatively be referred to as a third edge 222 and a fourth edge 224 when referencing the edges 222, 224 apart from the sole structure 104.

The lateral edge 215 may be disposed proximate to the lateral side 116 when incorporated into the sole structure 104 and may include a first segment 221 and a second segment 223. The first segment 221 is separated from the second segment 223 by the notch 214. Each segment 221, 223 includes a substantially straight portion extending along an axis $A_{221}$, $A_{223}$. As shown in FIG. 8, these axes $A_{221}$, $A_{223}$ are convergent with one another and are located on opposite sides of the notch 214. The first segment 221 and the second segment 223 each terminate at the notch 214. As shown, the segments 221, 223 transition into the notch 214 at a radius 225. The radius 225 associated with the first segment 221 and the radius 225 associated with the second segment 223 cooperate to define an opening to the notch 214 as well as the widest point of the notch 214.

As described above, the notch 214 may taper in a direction from the lateral edge 215 to the terminal end 219. As shown in FIGS. 8 and 9, the opening of the notch 214 is the widest point of the notch 214 and may include a different taper than the rest of the notch 214. For example, the notch 214 may taper to a greater extent at the portion of the notch 214 defined by the radii 225 as comparted to the portion of the notch 214 extending between the radii 225 and the terminal end 219.

The medial edge 217 is disposed on an opposite side of the bladder 200 than the lateral edge 215 and includes a substantially convex surface 227. The convex surface 227 may provide the medial edge 217 with a curved profile that matches or is substantially similar to a curvature of the midsole 126, as shown in FIG. 4. Providing the medial edge 217 with a curved profile that is similar to that of the midsole 126 allows the bladder 200 to align with an outer edge of the midsole 126 and, in so doing, maximize the amount of coverage the bladder 200 provides.

The anterior edge 222 extends between and connects the first segment 221 of the lateral edge 215 and the convex surface 227 of the medial edge 217. As shown in FIGS. 8 and 9, the anterior edge 222 is connected to the first segment 221 of the lateral edge 215 by an arcuate segment 229 and is connected to the medial edge 217 by an arcuate segment 231. The anterior edge 222 includes a substantially planar portion 233 extending between and connecting the arcuate segment 229 and the arcuate segment 233. The planar portion 233 extends along an axis $A_{233}$.

The posterior edge 224 extends between the second segment 223 of the lateral edge 215 and the convex surface 227 of the medial edge 217. As shown in FIGS. 8 and 9, the posterior edge 224 is connected to the second segment 223 of the lateral edge 215 by an arcuate segment 235 and is connected to the medial edge 217 by an arcuate segment 237. The posterior edge 224 includes a substantially planar portion 239 extending between and connecting the arcuate segment 235 and the arcuate segment 237. The planar portion 239 extends along an axis $A_{239}$.

The foregoing edges 215, 217, 222, 224 provide the bladder 200 with an asymmetric shape. Namely, the bladder 200 is asymmetric about an axis extending through the center of the bladder 200 from the lateral edge 215 to the medial edge 217 and is asymmetric about an axis extending through the center of the bladder 200 from the anterior edge 222 to the posterior edge 224.

With continued reference to FIGS. 8 and 9, the axis $A_{233}$ and the axis $A_{239}$ are shown as being convergent with one another. In the configuration shown in FIG. 9, the axes $A_{233}$, $A_{239}$ extend in a direction away from one another at the lateral edge 215. The axes $A_{233}$, $A_{239}$ extend away from one another at the lateral edge 215 due to the shape of the bladder 200 on either side of the notch 214. Specifically, the bladder 200 includes a first segment 240 disposed between the notch 214 and the anterior edge 222 and a second segment 242 disposed between the notch 214 and the posterior edge 224. The first segment 240 and the second segment 242 extend from a common location 244 between the terminal end 219 of the notch 214 and the medial edge 217. The first segment 240 extends from the medial edge 217 to the first segment 221 of the lateral edge 215. Similarly, the second segment 242 extends from the medial edge 217 to the second segment 223 of the lateral edge 215. As shown, the second segment 242 may be longer than the first segment 240. The second segment 242 may be longer than the first segment 240 to allow the second segment 242 to extend from the medial side 118 of the sole structure 104 within the forefoot region 106 to the lateral side 116 of the sole structure 104 in the midfoot region 108. This way, the bladder 200 can maximize coverage of the transition line LT to enhance cushioning and support during wear.

Figure 5:
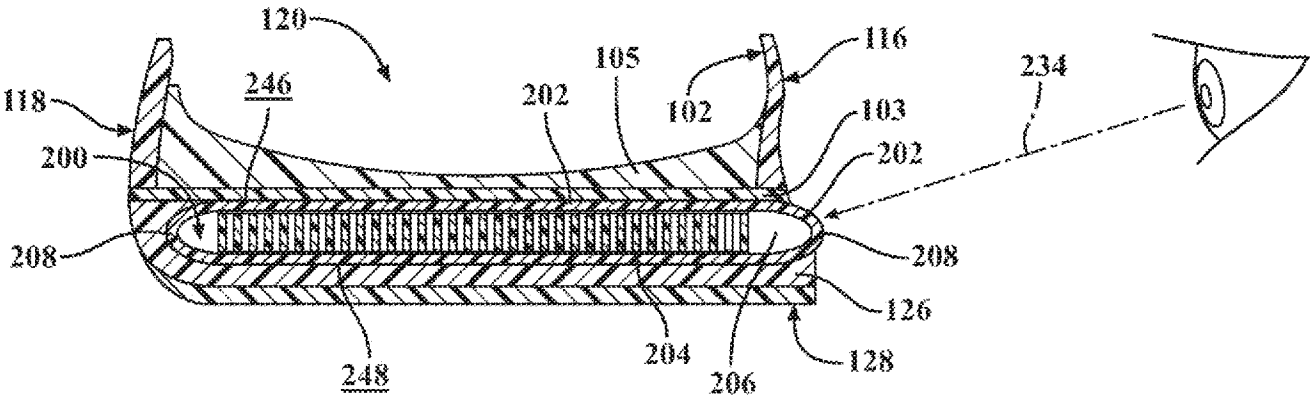
FIG. 5 is a cross-sectional view of the article of footwear of FIG. 1, taken along line 5-5 of FIG. 4.

Referring now to FIGS. 10-13, the peripheral seam 208 of the bladder 200 is formed where the first barrier element 202 and the second barrier element 204 are joined together. In one configuration, the barrier elements 202, 204 are joined together by melding a material of the first barrier element 202 and the second barrier element 204 together by subjecting the barrier elements 202, 204 to heat and or pressure at the location of the seam 208. As shown in FIG. 5, the seam 208 may be positioned relative to the midsole 126 such that the peripheral seam 208 is visible from the perspective of someone looking downwardly at the footwear 100, as depicted by reference number 234 (FIG. 5). Alternatively, the seam 208 could be hidden from view if the bladder 200 is entirely contained within the midsole 126. In such a configuration, a material of the midsole 126 prevents the bladder 200 and, thus, the seam 208, from being seen once installed in the midsole 126. Note that in one configuration, the bladder 200 is surrounded by a material of the midsole 126 such that the material of the midsole 126 extends between the bladder 200 and the strobel 103 and between the bladder 200 and the outsole 128. In another configuration, the outsole 128 may be directly attached to the bladder 200 at the lower barrier element 204 such that a material of the midsole 126 only extends around a portion of the bladder 200 and between the bladder 200 and the strobel 103.

In one configuration, and as shown in FIG. 10, the seam 208 can be positioned at an approximate midpoint of a thickness of the bladder 200 (i.e., substantially centrally located between the superior surface 246 and the inferior surface 248). Accordingly, the peripheral seam 208 extends around and defines an outer perimeter of the bladder 208 at a location that is approximately centrally located between the superior surface 246 and the inferior surface 248. Positioning the peripheral seam 208 proximate to a midpoint of a thickness of the bladder 200 within the notch 214 facilitates compression of the bladder 200 at the notch 214 by reducing the force required to collapse the bladder 200 along the length of the notch 214 and at the terminal end 219.

With reference to FIGS. 14-17, the seam **208*a* is shown as being positioned proximate to the inferior surface 248 around an entire perimeter of the bladder 200*a*. In view of the substantial similarity in structure and function of the bladder 200*a* with respect to the bladder 200**, like reference numerals are used hereinafter and in the drawings to identify like components while like reference numerals containing letter extensions are used to identify those components that have been modified.

Positioning the seam **200*a* proximate to the inferior surface 248 allows the seam 208*a* to be hidden from view once assembled into the midsole 126. Specifically, positioning the seam 208*a* proximate to the inferior surface 248** allows a material of the midsole 126 disposed between the bladder 200*a* and the outsole 128 to effectively cover the seam 208*a* to prevent the seam 208*a* from being viewed once assembled to the sole structure 104.

With reference to FIGS. 18-21, the seam 208*b* is shown as being positioned proximate to the superior surface 246 around an entire perimeter of the bladder 200*b*. In view of the substantial similarity in structure and function of the bladder 200*b* with respect to the bladder 200, like reference numerals are used hereinafter and in the drawings to identify like components while like reference numerals containing letter extensions are used to identify those components that have been modified.

Positioning the seam 200*b* proximate to the superior surface 246 allows the seam 208*b* to be hidden from view once assembled into the midsole 126. Specifically, positioning the seam 208*b* proximate to the superior surface 246 allows a material of the midsole 126 disposed between the bladder 200*b* and the strobel 103 to effectively cover the seam 208*b* to prevent the seam 208*b* from being viewed once assembled to the sole structure 104.

Regardless of where the seam 208, 208*a*, 208*b* is placed relative to the superior surface 246 and the inferior surface 248, the bladder 200 could be positioned within the sole structure 104 at the forefoot region 106 and the midfoot region 108 of the footwear 100, as shown in the figures or, alternatively, could be located at various other locations of the footwear (e.g., a heel region).

In some instances, a first barrier layer can comprise one or more properties (e.g., color, opacity, translucency, thickness, material type, etc.), and a second barrier layer can comprise one or more different properties. The different barrier layers can, for example, create different performance and/or aesthetic properties. For example, a bladder with barrier layers of different color can be configured such that the bladder appears to have a first color on a first portion (e.g., a lateral side) of the footwear and a second color on a second portion (e.g., a medial side) of the footwear.

The bladders 200, 200*a*, 200*b* can comprise various shapes. For example, as shown in FIG. 8, the medial and/or posterior sides of the bladder 200 can comprise an arcuate or curved shape. The lateral edge 215 can be angled or tapered from the notch 214 in the anterior-medial and/or posterior-medial directions. In other words, the bladder 200 is wider adjacent to the notch 214 than at the anterior-lateral and/or posterior-lateral corners of the bladder 200. When viewed from the superior side (e.g., FIG. 8), the bladder comprises a substantially "C" shape. In other examples, various other shapes, degrees of curvature, degrees of taper, etc. can be used.

In addition to being filled with a fluid, in some instances, at least a portion of a chamber of a bladder can be filled with one or more components. The filling material/components can, for example, improve the resiliency and/or durability of the bladder.

For example, referring to FIG. 22, the chamber 206 of the bladder 200 includes one or more tensile strands 226 disposed therein. In some examples, the tensile strands 226 can be referred to as tensile elements. Each tensile strand 226 can extend between an upper tensile sheet 228 and a lower tensile sheet 230. The upper tensile sheet 228 may be attached to the first barrier element 202 while the lower tensile sheet 230 may be attached to the second barrier element 204. In this manner, when the chamber 206 of the bladder 200 receives a pressurized fluid, the tensile strands 226 are placed in tension. Because the upper tensile sheet 228 is attached to the first barrier element 202 and the lower tensile sheet 230 is attached to the second barrier element 204, the tensile strands 226 retain a desired shape of the chamber 206 when pressurized fluid is injected into the chamber via a port 232.

In lieu of or in addition to the tensile strands, in some instances, a bladder can comprise a foam element disposed within a chamber of the bladder. For example, FIGS. 23 and 24 depict a bladder 300. The bladder 300 is configured similar to the bladders 200, 200*a*, 200*b*, except that the bladder 300 comprises a foam element 326 disposed in an interior portion 312 of a chamber 306 of the bladder 300 rather than having tensile strands 226 disposed in the chamber 206 like the bladders 200, 200*a*, 200*b*. Given the similarities between the bladders 200, 200*a*, 200*b* and the bladder 300, the reference numerals of the bladder 300 correspond to similar components of the bladders 200, 200*a*, 200*b*, unless stated otherwise. Namely, one hundred (100) is added to the corresponding reference number from the bladder 200 to identify like components in the bladder 300. For example, reference numerals 302 and 304 respectively correspond to reference numerals 202 and 204 in the bladder 200.

The bladder 300 can, for example, be used with the footwear 100 in lieu of the bladders 200, 200*a*, 200*b*. As with the bladders 200, 200*a*, 200*b*, the bladder 300 can be pressurized to a pressure above ambient pressure.

The bladders 200, 200*a*, 200*b*, and 300 can be formed in various ways. Several exemplary methods are provided below with respect to the bladder 200. The bladders 200*a*, 200*b*, 300 can be formed in a similar manner.

In some examples, a bladder can be formed without tensile strands and/or a foam element disposed within the chamber. For example, in some instances, the bladder 200 can be filled with a fluid via a port (e.g., the port 232) but not have any other material added to the chamber.

In some implementations, the upper and lower barrier elements 202, 204 are formed by respective mold portions each defining various surfaces for forming depressions and pinched surfaces corresponding to locations where the peripheral seam 208 is formed when the upper barrier element 202 and the lower barrier element 204 are joined and bonded together. In some implementations, adhesive bonding joins the upper barrier element 202 and the lower barrier element 204 to form the peripheral seam 208. In other implementations, the upper barrier element 202 and the lower barrier element 204 are joined to form the peripheral seam 208 by thermal bonding. In some examples, one or both of the barrier elements 202, 204 are heated to a temperature that facilitates shaping and melding. In some examples, the barrier elements 202, 204 are heated prior to being located between their respective molds. In other examples, the mold may be heated to raise the temperature of the barrier elements 202, 204. In some implementations, a molding process used to form the chamber 206 incorporates vacuum ports within mold portions to remove air such that the upper and lower barrier elements 202, 204 are drawn into contact with respective mold portions. In other implementations, fluids such as air may be injected into areas between the upper and lower barrier elements 202, 204 such that the resulting increase in pressure causes the barrier elements 202, 204 to engage with surfaces of their respective mold portions.

The cushioning member 130 and the bladder 200 of the midsole 126 can be configured to mate in various ways. For example, in some instances, the cushioning member 130 can be over-molded onto the bladder 200 such that the bladder 200 is at least partially embedded or encapsulated by the cushioning member 130. In such instances, a top surface of the cushioning member 130 defines a profile of the footbed and may be contoured to correspond to a shape of the foot. Further, a material of the cushioning member 130 may completely or partially fill the notch 214. As shown in FIGS. 1 and 2, a material of the cushioning member 130 fills the notch 214 and separates the first segment 221 of the lateral edge 215 from the second segment 223 of the lateral edge 215 at an outer periphery of the sole structure 104. In other instances, the cushioning member 130 can be formed with a recessed pocket configured to receive the bladder 200. In such instances, a top surface of the cushioning member 130 and the superior surface 246 of the bladder 200 define a profile of the footbed and may be contoured to correspond to a shape of the foot. Finally, a bottom surface of the cushioning member 130 may cooperate with the bladder 200, whereby the bottom surface can, in some examples, include a pocket formed in the forefoot region 106 and/or the midfoot region 108 that interfaces with the bladder 200.

Peripheral surfaces of the cushioning member 130, including lateral and/or medial side surfaces, can include one or more recesses or windows. In some examples, a window can allow one or more portions of the bladder 200 to be visible and/or partially protrude from the peripheral surface of the cushioning member 130. For example, referring to FIGS. 2 and 3, the lateral side of the cushioning member 130 includes two lateral windows 132 and one medial window 134. In other examples, a cushioning member can have more or fewer windows than the depicted example. The windows can be disposed at various other locations (e.g., a heel region).

In other instances where the bladder 200 is fully encapsulated (i.e., completely surrounded) by the cushioning member 130, windows are not provided in the cushioning member 130. In these instances, the bladder 200 is hidden from view by a material of the cushioning member 130.

As described above, the cushioning member 130 is formed of a resilient polymeric material, such as foam or rubber, to impart properties of cushioning, responsiveness, and energy distribution to the foot of the wearer. Example resilient polymeric materials for the cushioning member 130 may include those based on foaming or molding one or more polymers, such as one or more elastomers (e.g., thermoplastic elastomers (TPE)). The one or more polymers may include aliphatic polymers, aromatic polymers, or mixtures of both; and may include homopolymers, copolymers (including terpolymers), or mixtures of both.

In some instances, the one or more polymers may include olefinic homopolymers, olefinic copolymers, or blends thereof. Examples of olefinic polymers include polyethylene, polypropylene, and combinations thereof. In other aspects, the one or more polymers may include one or more ethylene copolymers, such as, ethylene-vinyl acetate (EVA) copolymers, EVOH copolymers, ethylene-ethyl acrylate copolymers, ethylene-unsaturated mono-fatty acid copolymers, and combinations thereof.

In further examples, the one or more polymers may include one or more polyacrylates, such as polyacrylic acid, esters of polyacrylic acid, polyacrylonitrile, polyacrylic acetate, polymethyl acrylate, polyethyl acrylate, polybutyl acrylate, polymethyl methacrylate, and polyvinyl acetate; including derivatives thereof, copolymers thereof, and any combinations thereof.

In yet further examples, the one or more polymers may include one or more ionomeric polymers. In these aspects, the ionomeric polymers may include polymers with carboxylic acid functional groups, sulfonic acid functional groups, salts thereof (e.g., sodium, magnesium, potassium, etc.), and/or anhydrides thereof. For instance, the ionomeric polymer(s) may include one or more fatty acid-modified ionomeric polymers, polystyrene sulfonate, ethylene-methacrylic acid copolymers, and combinations thereof.

In further examples, the one or more polymers may include one or more styrenic block copolymers, such as acrylonitrile butadiene styrene block copolymers, styrene acrylonitrile block copolymers, styrene ethylene butylene styrene block copolymers, styrene ethylene butadiene styrene block copolymers, styrene ethylene propylene styrene block copolymers, styrene butadiene styrene block copolymers, and combinations thereof.

In further examples, the one or more polymers may include one or more polyamide copolymers (e.g., polyamide-polyether copolymers) and/or one or more polyurethanes (e.g., crosslinked polyurethanes and/or thermoplastic polyurethanes). Examples of suitable polyurethanes include those discussed above for barrier elements 202, 204. Alternatively, the one or more polymers may include one or more natural and/or synthetic rubbers, such as butadiene and isoprene.

When the resilient polymeric material is a foamed polymeric material, the foamed material may be foamed using a physical blowing agent which phase transitions to a gas based on a change in temperature and/or pressure, or a chemical blowing agent which forms a gas when heated above its activation temperature. For example, the chemical blowing agent may be an azo compound such as adodicarbonamide, sodium bicarbonate, and/or an isocyanate.

In some instances, the foamed polymeric material may be a crosslinked foamed material. In these examples, a peroxide-based crosslinking agent such as dicumyl peroxide may be used. Furthermore, the foamed polymeric material may include one or more fillers such as pigments, modified or natural clays, modified or unmodified synthetic clays, talc glass fiber, powdered glass, modified or natural silica, calcium carbonate, mica, paper, wood chips, and the like.

The resilient polymeric material may be formed using a molding process. In one example, when the resilient polymeric material is a molded elastomer, the uncured elastomer (e.g., rubber) may be mixed in a Banbury mixer with an optional filler and a curing package such as a sulfur-based or peroxide-based curing package, calendared, formed into shape, placed in a mold, and vulcanized.

In another example, when the resilient polymeric material is a foamed material, the material may be foamed during a molding process, such as an injection molding process. A thermoplastic polymeric material may be melted in the barrel of an injection molding system and combined with a physical or chemical blowing agent and optionally a crosslinking agent, and then injected into a mold under conditions which activate the blowing agent, forming a molded foam.

Optionally, when the resilient polymeric material is a foamed material, the foamed material may be a compression molded foam. Compression molding may be used to alter the physical properties (e.g., density, stiffness and/or durometer) of a foam, or to alter the physical appearance of the foam (e.g., to fuse two or more pieces of foam, to shape the foam, etc.), or both.

The compression molding process desirably starts by forming one or more foam preforms, such as by injection molding and foaming a polymeric material, by forming foamed particles or beads, by cutting foamed sheet stock, and the like. The compression molded foam may then be made by placing the one or more preforms formed of foamed polymeric material(s) in a compression mold and applying sufficient pressure to the one or more preforms to compress the one or more preforms in a closed mold. Once the mold is closed, sufficient heat and/or pressure is applied to the one or more preforms in the closed mold for a sufficient duration of time to alter the preform(s) by forming a skin on the outer surface of the compression molded foam, fuse individual foam particles to each other, permanently increase the density of the foam(s), or any combination thereof. Following the heating and/or application of pressure, the mold is opened, and the molded foam article is removed from the mold.

As mentioned above, the outsole 128 (see, e.g., FIGS. 1 and 4) is the primary ground-engaging surface of the footwear 100. Although shown schematically as a relatively smooth surface for purposes of illustration, the outsole 128 can include various traction-enhancing elements. For example, an outsole can include grooves, lugs, ribs, spikes, cleats, etc. The outsole can, in some instances, be relatively uniform across the footwear. In other instances, the outsole can comprise various segments with different materials and/or traction-enhancing elements. In addition to being disposed on the inferior surface of the footwear, in some examples, the outsole can be disposed on one or more other surfaces. For example, an outsole can comprise a toe cap and/or a heel cap configured to protect ends of the footwear.

The outsole 128 can be formed of resilient materials that impart properties of abrasion resistance and traction to the sole structure 104. One or more of the outsole segments may be formed of a first material having a higher durometer than the others of the outsole segments. For example, one segment may be formed of a rubber material having a first durometer, while another segment is formed of a foam material having a second durometer, less than the first durometer.

In the foregoing examples, the bladders 200, 200*a*, 200*b*, 300 serve to provide an article of footwear 100 with support and cushioning properties. The bladders 200, 200*a*, 200*b*, 300 may include a notch 214 to facilitate bending of the bladders 200, 200*a*, 200*b*, 300 during use, thereby providing the bladders 200, 200*a*, 200*b*, 300 with stability and improved aesthetics simultaneously.

The following Clauses provide an exemplary configuration for a bladder for an article of footwear described above.

Clause 1. A bladder comprising a first barrier element, a second barrier element opposing the first barrier element, and a peripheral seam joining the first barrier element and the second barrier element to define a first fluid-filled segment extending from a first side of the bladder to a second side of the bladder, a second fluid-filled segment extending from the first side of the bladder to the second side of the bladder, and a notch extending between and separating distal ends of the first fluid-filled segment and the second fluid-filled segment, the first fluid-filled segment extending along a first axis and the second fluid-filled segment extending along a second axis convergent with the first axis.

Clause 2. The bladder of Clause 1, wherein the first fluid-filled segment is elongate.

Clause 3. The bladder of Clause 1 or 2, wherein the second fluid-filled segment is elongate.

Clause 4. The bladder of any of Clauses 1-3, wherein the notch is elongate and terminates at a terminal end between the first side of the bladder and the second side of the bladder.

Clause 5. The bladder of Clause 4, wherein the terminal end extends between 10% to 40% of a total width of the bladder from the second side of the bladder toward the first side of the bladder.

Clause 6. The bladder of any of the preceding Clauses, wherein the notch extends from an opening located at the second side of the bladder to a terminal end disposed between the first side of the bladder and the second side of the bladder.

Clause 7. The bladder of Clause 6, wherein the notch includes a substantially constant width.

Clause 8. The bladder of Clause 6, wherein the notch tapers in a direction from the opening toward the terminal end.

Clause 9. The bladder of any of the preceding Clauses, wherein the bladder is pressurized.

Clause 10. An article of footwear incorporating the bladder of any of the preceding Clauses.

Clause 11. A bladder comprising a first barrier element, a second barrier element opposing the first barrier element, and a peripheral seam joining the first barrier element and the second barrier element to define a first fluid-filled segment extending from a first side of the bladder to a second side of the bladder, a second fluid-filled segment extending from the first side of the bladder to the second side of the bladder, and a notch extending between and separating distal ends of the first fluid-filled segment and the second fluid-filled segment, the distal end of the first fluid-filled segment and the distal end of the second fluid-filled segment extending away from one another at the second side of the bladder.

Clause 12. The bladder of Clause 11, wherein the first fluid-filled segment is elongate.

Clause 13. The bladder of Clause 11 or 12, wherein the second fluid-filled segment is elongate.

Clause 14. The bladder of any of Clauses 11-13, wherein the notch is elongate and terminates at a terminal end between the first side of the bladder and the second side of the bladder.

Clause 15. The bladder of Clause 14, wherein the terminal end extends between 10% to 40% of a total width of the bladder from the second side of the bladder toward the first side of the bladder.

Clause 16. The bladder of any of the preceding Clauses, wherein the notch extends from an opening located at the second side of the bladder to a terminal end disposed between the first side of the bladder and the second side of the bladder.

Clause 17. The bladder of Clause 16, wherein the notch includes a substantially constant width.

Clause 18. The bladder of Clause 16, wherein the notch tapers in a direction from the opening toward the terminal end.

Clause 19. The bladder of any of the preceding Clauses, wherein the bladder is pressurized.

Clause 20. An article of footwear incorporating the bladder of any of the preceding Clauses.

The foregoing description has been provided for purposes of illustration and description. It is not intended to be exhaustive or to limit the disclosure. Individual elements or features of a particular configuration are generally not limited to that particular configuration, but, where applicable, are interchangeable and can be used in a selected configuration, even if not specifically shown or described. The same may also be varied in many ways. Such variations are not to be regarded as a departure from the disclosure, and all such modifications are intended to be included within the scope of the disclosure.

What is claimed is:

1. A bladder comprising:

a first barrier element;

a second barrier element opposing the first barrier element;

a peripheral seam joining the first barrier element and the second barrier element to define a first fluid-filled segment extending from a first side of the bladder to a second side of the bladder, a second fluid-filled segment extending from the first side of the bladder to the second side of the bladder, and a notch extending between and separating distal ends of the first fluid-filled segment and the second fluid-filled segment, the first fluid-filled segment extending along a first axis and the second fluid-filled segment extending along a second axis convergent with the first axis; and a chamber formed from the first barrier element and the second barrier element and bounded by the peripheral seam, the chamber including an interior portion in fluid communication with a border portion extending between the peripheral seam and the interior portion, the border portion having a first thickness along the notch and a second thickness along a remainder of the border portion that is greater than the first thickness.

2. The bladder of claim 1, wherein the first fluid-filled segment is elongate.

3. The bladder of claim 2, wherein the second fluid-filled segment is elongate.

4. The bladder of claim 3, wherein the notch is elongate and terminates at a terminal end between the first side of the bladder and the second side of the bladder.

5. The bladder of claim 4, wherein the terminal end extends between 10% and 40% of a total width of the bladder from the second side of the bladder toward the first side of the bladder.

6. The bladder of claim 1, wherein the notch extends from an opening located at the second side of the bladder to a terminal end disposed between the first side of the bladder and the second side of the bladder.

7. The bladder of claim 6, wherein the notch includes a substantially constant width.

8. The bladder of claim 6, wherein the notch tapers in a direction from the opening toward the terminal end.

9. The bladder of claim 1, wherein the bladder is pressurized.

10. An article of footwear incorporating the bladder of claim 1.

11. A bladder comprising:

a first barrier element;

a second barrier element opposing the first barrier element;

a peripheral seam joining the first barrier element and the second barrier element to define a first fluid-filled segment extending from a first side of the bladder to a second side of the bladder, a second fluid-filled segment extending from the first side of the bladder to the second side of the bladder, and a notch extending between and separating distal ends of the first fluid-filled segment and the second fluid-filled segment, the distal end of the first fluid-filled segment and the distal end of the second fluid-filled segment extending away from one another at the second side of the bladder; and a chamber formed from the first barrier element and the second barrier element and bounded by the peripheral seam, the chamber including an interior portion in fluid communication with a border portion extending between the peripheral seam and the interior portion, the border portion having a first thickness along the notch and a second thickness along a remainder of the border portion that is greater than the first thickness.

12. The bladder of claim 11, wherein the first fluid-filled segment is elongate.

13. The bladder of claim 12, wherein the second fluid-filled segment is elongate.

14. The bladder of claim 13, wherein the notch is elongate and terminates at a terminal end between the first side of the bladder and the second side of the bladder.

15. The bladder of claim 14, wherein the terminal end extends between 10% and 40% of a total width of the bladder from the second side of the bladder toward the first side of the bladder.

16. The bladder of claim 11, wherein the notch extends from an opening located at the second side of the bladder to a terminal end disposed between the first side of the bladder and the second side of the bladder.

17. The bladder of claim 16, wherein the notch includes a substantially constant width.

18. The bladder of claim 16, wherein the notch tapers in a direction from the opening toward the terminal end.

19. The bladder of claim 11, wherein the bladder is pressurized.

20. An article of footwear incorporating the bladder of claim 11.

* * * * *